US008777342B2

(12) United States Patent
Matsubara

(10) Patent No.: US 8,777,342 B2
(45) Date of Patent: Jul. 15, 2014

(54) INK CONTAINER AND IMAGE FORMING APPARATUS

(75) Inventor: Mitsuya Matsubara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 194 days.

(21) Appl. No.: 13/361,123

(22) Filed: Jan. 30, 2012

(65) Prior Publication Data

US 2012/0194582 A1 Aug. 2, 2012

(30) Foreign Application Priority Data

Feb. 2, 2011 (JP) ..... 2011-021106

(51) Int. Cl.
*B41J 2/195* (2006.01)

(52) U.S. Cl.
USPC ..... 347/7; 347/86

(58) Field of Classification Search
USPC ..... 347/7, 84–86
See application file for complete search history.

(56) References Cited

U.S. PATENT DOCUMENTS

| | | | | |
|---|---|---|---|---|
| 5,963,237 | A | 10/1999 | Ikkatai et al. | |
| 6,099,101 | A * | 8/2000 | Maurelli et al. | 347/7 |
| 7,920,373 | B2 | 4/2011 | Matsubara | |
| 2006/0061620 | A1 * | 3/2006 | Tani et al. | 347/36 |
| 2009/0141076 | A1 * | 6/2009 | Muhl et al. | 347/33 |
| 2009/0160915 | A1 * | 6/2009 | Takahashi et al. | 347/85 |

FOREIGN PATENT DOCUMENTS

| | | |
|---|---|---|
| JP | 2-201123 | 8/1990 |
| JP | 9-262987 | 10/1997 |
| JP | 2004-188933 | 7/2004 |
| JP | 3684022 | 6/2005 |
| JP | 2010-5843 | 1/2010 |
| JP | 2010-5845 | 1/2010 |

* cited by examiner

*Primary Examiner* — Manish S Shah
*Assistant Examiner* — Yaovi Ameh
(74) *Attorney, Agent, or Firm* — Cooper & Dunham LLP

(57) ABSTRACT

Disclosed is an ink container rotatable to take a first position and a second position, including an ink reservoir containing ink; and first and second detecting sensors connected to a detecting unit that determines whether the ink reservoir contains a predetermined amount of the ink based on current flowing through the first and second detecting sensors. The first and second detecting sensors are provided to face directions different from each other such that whether the ink reservoir contains a first predetermined amount of the ink for the first position is determined based on whether the first detecting sensor contacts the ink when the ink container takes the first position, and whether the ink reservoir contains a second predetermined amount of the ink for the second position is determined based on whether the second detecting sensor contacts the ink when the ink container takes the second position.

16 Claims, 21 Drawing Sheets

INK CONTAINER AND IMAGE FORMING APPARATUS

BACKGROUND OF THE INVENTION

1. Field of the Invention

The present invention relates to an ink container and an image forming apparatus including the ink container, and more specifically, to an ink container provided in an image forming apparatus such as an inkjet copying machine, an inkjet facsimile machine, an inkjet printer or the like and integrally formed with a head that discharges ink; and the image forming apparatus including the ink container.

2. Description of the Related Art

For many cases, in an inkjet image forming apparatus such as an inkjet copying machine, an inkjet facsimile machine, an inkjet printer or the like, a head discharges ink downward onto a recording medium such as a recording paper (for example, see Patent Document 1 to Patent Document 5). In some cases, in an inkjet image forming apparatus, a head discharges ink in a lateral direction or in an inclined direction (for example, see Patent Document 6).

Further, for such an inkjet image forming apparatus, a structure is known where a cap is provided on a discharging surface of the head in order to prevent drying of the ink (for example, see Patent Document 1 to Patent Document 4). When the head is the type that discharges the ink downward onto the recording medium, the cap caps the head in the upper direction and the ink usually does not leak from the cap even when the ink becomes attached to the cap. However, when the head is the type that discharges the ink in the lateral direction or in the inclined direction, the ink attached to the cap may leak and may contaminate the inside of the image forming apparatus.

Therefore, as for the image forming apparatus in which the head discharges the ink in the lateral direction or in the inclined direction, it may be considered to rotate the head to face downward to be capped with a cap facing upward when capping the head. Thus, there is a case when it is desirable to structure the image forming apparatus such that the position of the head is changeable based on the situation.

On the other hand, a technique to detect the amount of the ink in the ink reservoir which is integrally formed with the head using the conductivity of the ink for appropriately adjusting the amount of the ink in the ink reservoir is known (for example, see Patent Document 1 to Patent Document 7).

Further, a structure where the ink container is a sub tank is also known (for example, see Patent Document 1 to Patent Document 4). The sub tank receives the ink supplied from the ink cartridge, which is the main tank, via a tube or the like. The sub tank functions as a reservoir tank so that the formation of an image can be performed even after the ink cartridge becomes empty. Further, the sub tank may function as a negative pressure forming unit for preventing the leakage of the ink from the head.

However, when the position of the head is changeable, even when the amount of the ink can be detected by the conventional technique to detect the amount of the ink at one position, the amount of the ink cannot be properly detected by the conventional technique at another position.

PATENT DOCUMENTS

[Patent Document 1] Japanese Laid-open Patent Publication No. 2010-5843

[Patent Document 2] Japanese Laid-open Patent Publication No. 2010-5845

[Patent Document 3] Japanese Patent No. 3684022

[Patent Document 4] Japanese Laid-open Patent Publication No. H10-6521

[Patent Document 5] Japanese Laid-open Patent Publication No. 2004-188933

[Patent Document 6] Japanese Laid-open Patent Publication No. H2-201123

[Patent Document 7] Japanese Laid-open Patent Publication No. H9-262987

SUMMARY OF THE INVENTION

The present invention is made in light of the above problems, and an embodiment provides an ink container provided in an image forming apparatus such as an inkjet copying machine, an inkjet facsimile machine, an inkjet printer or the like, integrally formed with a head that discharges ink, and capable of detecting the amount of the ink even when the position of the head is changed; and the image forming apparatus including the ink container.

According to an embodiment, there is provided an ink container integrally formed with a head that discharges ink and rotatable to take a first position where the ink is discharged from the head and a second position different from the first position where the position of the head is different for the first position and the second position. The ink container includes an ink reservoir that contains the ink to be discharged from the head; and a first detecting sensor and a second detecting sensor to be connected to a detecting unit that determines whether the ink reservoir contains a predetermined amount of the ink based on current flowing through the first detecting sensor and the second detecting sensor, the first detecting sensor and the second detecting sensor being provided to face directions different from each other such that whether the ink reservoir contains a first predetermined amount of the ink for the first position is determined based on whether the first detecting sensor contacts the ink when the ink container takes the first position, and whether the ink reservoir contains a second predetermined amount of the ink for the second position is determined based on whether the second detecting sensor contacts the ink when the ink container takes the second position.

According to another embodiment, there is provided an image forming apparatus including the ink container.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
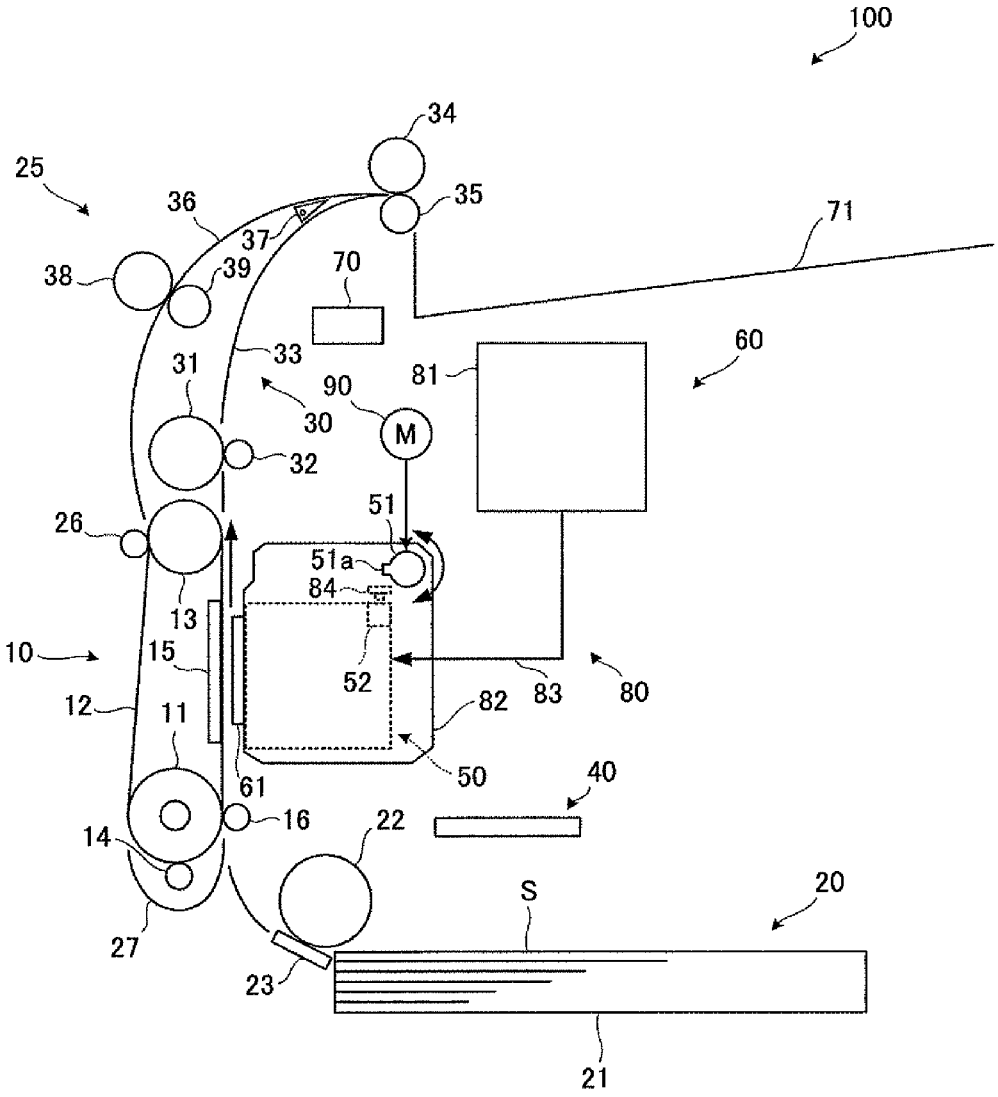
FIG. 1 is a side view of an example of an image forming apparatus according to an embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

Next, embodiments of the present invention will be described below with reference to drawings.

It is to be noted that, in the explanation of the drawings, the same components are given the same reference numerals, and explanations are not repeated.

FIG. 1 is a side view of an example of an image forming apparatus 100 according to an embodiment.

In this embodiment, the image forming apparatus 100 is an inkjet printer. The image forming apparatus 100 forms a multiple-color image. The multiple-color image may be a full-color image using four colors, 6 colors, 7 colors, 8 colors or the like. For example, the full-color image using four colors may include yellow (Y), magenta (M), cyan (C), and black (K). The colors are not so limited and various colors may be used for the full-color image using four colors, 6 colors, 7 colors, 8 colors or the like. Alternatively, the image forming apparatus 100 may form a mono-color image.

The image forming apparatus 100 is a serial type as will be described in the following. Alternatively, the image forming apparatus 100 may be a line head type where a head is not moved in a main scanning direction when discharging ink to form an image.

The image forming apparatus 100 may be any type of apparatus as long as it forms an image using ink such as a copying machine, a facsimile machine, a plotter, an electronic circuit forming apparatus in which liquid including conductive material is used as ink and an electronic circuit having a conductive path is formed by the ink discharged from the head, or a multifunction machine including combinations of these.

The term "image forming apparatus" in this embodiment includes an apparatus by which an image is formed by providing ink on a medium such as a paper, a thread, a textile, a fiber, a leather, a metal, a plastic, a glass, a wood material, ceramics or the like.

The term "image formation" in this embodiment is synonymous with recording, writing, drawing, or printing and includes forming a meaningless image such as a pattern or the like on the medium, in other words just providing ink on the medium, in addition to forming an image with some meaning such as characters, drawings and the like on the medium.

The term "ink" in this embodiment is used as a generic for a liquid capable of forming an image such as recording liquid, fixing treatment liquid, a solution, resin, or the like which includes liquid or droplets actually called ink.

The terms "medium", "recording medium", and "paper" in this embodiment are not limited to a material composed of paper and are used as a generic for a thing on which ink is attached such as a medium to be printed on, a recording paper or the like.

The term "image" in this embodiment includes a three-dimensional image such as an image formed on a three-dimensional body or a stereoscopically formed image of a three-dimensional body in addition to a plane image.

The image forming apparatus 100 is capable of forming an image on a sheet shaped recording medium such as an overhead projector film (OHP sheet), a paperboard such as a card, post card or the like, an envelope, or the like in addition to an ordinary paper generally used for copying or the like. The image forming apparatus 100 in this embodiment is a duplex image forming apparatus capable of forming images on both sides of a paper S, which is a recording medium. Alternatively, the image forming apparatus 100 may be a single side image forming apparatus which forms an image only on one side of the paper S.

The image forming apparatus 100 forms images based on an image signal corresponding to image information received from an external device.

The image forming apparatus 100 includes a main body that contains a paper-feed unit 20 which is a paper-feed tray, a transferring mechanism 10 which is a paper transferring unit, an image forming unit 60 which is an ink discharging device, a paper ejecting unit 30, a paper-catch tray 71, a reverse unit 25, a maintenance and recovery mechanism 40, a control unit 70 and a head position driver 90 including a motor.

The paper-feed unit 20 is capable of containing plural of the papers S and sends the papers S to the transferring mechanism 10 sequentially.

The transferring mechanism 10 transfers the paper S in the vertical direction while having the paper S face the image forming unit 60.

The image forming unit 60 forms a multi-color image on the paper S transferred by the transferring mechanism 10.

The image forming unit 60 includes a head 61, which is an ink discharging body, that discharges the ink of each of the multiple colors in droplets. As the image forming apparatus 100 of the embodiment is a serial type image forming apparatus, the image forming unit 60 supports the head 61 such that the head 61 moves in a main scanning direction, which is perpendicular to a paper plane of FIG. 1, while discharging the ink in a horizontal direction to form an image.

The paper ejecting unit 30 further transfers the paper S on which the image has been formed by the image forming unit 60.

The paper-catch tray 71 receives the paper S transferred by the paper ejecting unit 30. The paper-catch tray 71 is capable of receiving a lot of the papers S.

To perform duplex printing, the reverse unit 25 receives the paper S on one surface, which is a front surface on which the image is formed, from the paper ejecting unit 30 to reverse the paper S while it is being transferred downward by the transferring mechanism 10. The transferring mechanism 10 then transfers the paper S upward to be facing the head 61 of the image forming unit 60 to have the image forming unit 60 form another image on the other surface, which is a back surface.

The maintenance and recovery mechanism 40 is positioned below the image forming unit 60 and maintains and recovers the condition of nozzles, not shown in the drawing, of the head 61.

The motor of the head position driver 90 is a driver that drives the image forming unit 60 so that the head 61 of the image forming unit 60 takes either of an image forming position or a maintenance position. At the image forming position, the head 61 faces leftward as shown in FIG. 1 to discharge ink in the horizontal direction and form an image on the paper S. At the maintenance position, the head 61 faces downward to be capped by the maintenance and recovery mechanism 40, which will be explained later.

The control unit 70 includes a CPU, a memory and the like for controlling the entirety of the image forming apparatus 100.

The transferring mechanism 10 includes a transfer roller 11, which is a drive roller, a driven roller 13, a charge roller 14, a platen member 15, a press roller 16, and a paper transfer driver not shown in the drawings.

The transfer belt 12 has no ends and is held by the transfer roller 11 and the driven roller 13. The paper transfer driver, not shown in the drawings, rotates the transfer roller 11 for intermittently transferring the paper S in the vertical direction to face the head 61.

The charge roller 14 contacts the transfer belt 12 at the lower side of the transfer roller 11 to charge the transfer belt 12 for having the transfer belt 12 electrostatically attract the paper S.

The platen member 15 is positioned within the transfer belt 12 at a certain distance from the head 61 when the image forming unit 60 is in the image forming position to maintain flatness of the transfer belt 12 so that the image is properly formed on the paper S held by the transfer belt 12.

The press roller 16 contacts the transfer belt 12 at the right side of the transfer roller 11 to have the paper S transferred by the paper-feed unit 20 electrostatically attracted by the transfer belt 12.

The paper-feed unit 20 includes a paper-feed cassette 21, a paper-feed roller 22, a separation pad 23, a motor not shown in the drawing, and the like.

The paper-feed cassette 21 is capable of containing plural of the papers S. The paper-feed roller 22 and the separation pad 23 transfer only the topmost paper S of the papers S in the paper-feed cassette 21 to be inserted between the transfer belt 12 and the press roller 16. The motor, not shown in the drawings, rotates the paper-feed roller 22 to transfer the paper S.

The paper ejecting unit 30 includes a paper ejecting transfer roller 31, a spur 32, a paper ejecting guide member 33, a paper ejecting roller 34, and a spur 35.

The paper ejecting transfer roller 31 further transfers the paper S having been transferred by the transferring mechanism 10. The spur 32 contacts the paper ejecting transfer roller 31.

The paper ejecting guide member 33 has a curved shape forming an ejecting path and guiding the paper S transferred by the paper ejecting transfer roller 31 and the spur 32 so that the paper S is ejected with its printed surface facing down.

The paper ejecting roller 34 ejects the paper S guided by the paper ejecting guide member 33 onto the paper-catch tray 71. The spur 35 contacts the paper ejecting roller 31.

The reverse unit 25 includes a reverse guide member 36, a changeover claw 37, a reverse roller 38, a spur 39, a transfer assist roller 26 which is a driven assist roller, and a bypass guide member 27.

The reverse guide member 36 forms a reverse path for guiding the paper S to the transferring mechanism 10 when the paper S is partially ejected and then switched back to be reversed by the paper ejecting roller 34 and the spur 35.

The changeover claw 37 introduces the paper S to the reverse path formed by the reverse guide member 36, not to the ejecting path formed by the paper ejecting guide member 33.

The reverse roller 38 transfers the paper S guided by the reverse guide member 36 to the transferring mechanism 10. The spur 39 contacts the reverse roller 38.

The transfer assist roller 26 contacts the transfer belt 12 at the left side of the driven roller 13 in FIG. 1. The transfer assist roller 26 presses the paper S guided and transferred along the reverse guide member 36 by the reverse roller 38 and the spur 39 to the transfer belt 12 to be electrostatically attached.

The bypass guide member 27 guides the paper S held on and moved along with the transfer belt 12 by the transfer assist roller 26 to bypass the charge roller 14 to be inserted between the transfer belt 12 and the press roller 16.

The maintenance and recovery mechanism 40 includes, although not shown in the drawings, a cap, a wiper blade which is a wiper member, an ink receiver, and a moving unit.

The cap caps a nozzle surface of the head 61 when the head 61 takes the maintenance position where the head 61 faces downward. The wiper blade wipes the nozzle surface of the head 61 when the head 61 takes the maintenance position. The cleaning unit includes a pump suction unit that suctions the ink in nozzles of the head 61 for cleaning when the head 61 takes the maintenance position. The ink receiver receives the ink when thickened ink in the nozzles is suctioned by the pump suction unit of the cleaning unit. The moving unit moves these components upward and downward to have them function as described above. Further, the moving unit moves these components upward and downward so that these components do not contact the head 61 when the head position driver 90 drives the image forming unit 60.

The image forming unit 60 further includes an ink supply device 80, which is a liquid supply device. The ink supply device 80 supplies the ink to the head 61.

The ink supply device 80 includes an ink cartridge 81 (a liquid tank) which is a main tank, a carriage 82, a guide rod 51 which is a support member, a tube 83, a main scanning driver not shown in the drawings, and a pump not shown in the drawings.

The ink cartridge 81 contains ink to be supplied to the head 61.

The carriage 82 contains a sub tank 50 (ink container) which is a head tank, and a switch mechanism 84 in its inside. The sub tank 50 functions as a head supporter that supports the head 61. The sub tank 50 temporarily contains the ink supplied from the ink cartridge 81 to be discharged onto the paper S through the head 61. The tube 83 connects the ink cartridge 81 and the sub tank 50 and is a supply path for supplying the ink to the sub tank 50 in the ink cartridge 81.

The guide rod 51 supports the carriage 82 with the sub tank 50 and the head 61 slidably along the main scanning direction. The main scanning driver, not shown in the drawings, slides the carriage 82 with the sub tank 50 and the head 61 along the guide rod 51 to be moved in the main scanning direction.

The operation of the switch mechanism 84 is controlled by the control unit 70 to open the sub tank 50 when the ink in the ink cartridge 81 is supplied to the sub tank 50 through the tube 83.

The operation of the pump, not shown in the drawings, is also controlled by the control unit 70 so that the ink in the ink cartridge 81 is pumped to be supplied to the sub tank 50 when the sub tank 50 is opened by the switch mechanism 84 through the tube 83.

The ink cartridge 81 is removable from the main body of the image forming apparatus 100 so that the ink cartridge 81 is exchanged for a new ink cartridge when the ink in the ink cartridge 81 decreases, is used, becomes empty or the like. With this structure, the maintenance of the image forming apparatus 100 can be easier to perform.

The guide rod 51 includes a protruding portion 51*a* formed to extend along the main scanning direction. The protruding portion 51*a* defines the position of the carriage 82 such that the carriage 82 does not rotate freely around the guide rod 51.

When the guide rod 51 is rotated by the head position driver 90, the sub tank 50 and the head 61 rotate with the carriage 82 to take either a first position, which is a home position and the image forming position, where the head 61 faces leftward and discharges ink in the horizontal direction to form an image as shown in FIG. 1; or a second position, which is a capping position and the maintenance position, where the head 61 faces downward to be capped by the maintenance and recovery mechanism 40. At this time, the carriage 82 is rotated around the guide rod 51. When the sub tank 50 is rotated from the first position to the second position, the sub tank 50 is rotated about 90 degrees. In this embodiment, a first electrode 53*a* and a second electrode 53*b* (see FIG. 2A) face directions perpendicular to each other.

The sub tank 50 includes a valve unit 52. The valve unit 52 is driven by the switch mechanism 84 to open the inside of the sub tank 50. The tube 83 is connected to the sub tank 50. The valve unit 52 has a function to introduce the ink pumped in the tube 83 into the sub tank 50 when the inside of the sub tank 50 is opened by the switch mechanism 84 and to release the air in the sub tank 50 in accordance with the introduction of the ink.

A negative pressure forming unit may be provided in the sub tank 50 that forms a negative pressure in the sub tank 50 for preventing the leakage of the ink. Alternatively, the sub tank 50 may be an ink tank such as an ink cartridge 81 as long as it is rotatable with the head 61.

As described above, the sub tank 50 takes the first position and the second position when the guide rod 51 is rotated by the head position driver 90 where the position of the head 61 changes. At this time, with the rotation of the sub tank 50, the valve unit 52 also moves and at least a part of the switch mechanism 84 moves leftward and rightward in accordance with the movement of the valve unit 52 so that the switch mechanism 84 can drive the valve unit 52 at both positions.

In the switch mechanism 84 of the embodiment, an actuator or the like to drive the valve unit 52 is commonly used for the valve unit 52 at the first position and at the second position to result in low cost. Alternatively, as will be explained later, the switch mechanism 84 may include plural actuators or the like respectively for the valve unit 52 at the first position and at the second position. As the head 61 discharges the ink in a horizontal direction in the image forming apparatus 100, the image forming apparatus 100 is a so-called vertical type or upright printer. Therefore, a space necessary for the image forming apparatus 100 can be reduced.

Although not shown in the drawings, the image forming apparatus 100 includes plural sets of the ink cartridge 81, the sub tank 50, the tube 83, the switch mechanism 84, and the pump, not shown in the drawings, corresponding to the plural colors used in the image forming apparatus 100.

The head 61 includes plural vertical nozzle rows (head 61 in the image forming position). The nozzle rows may be provided corresponding to plural colors used in the image forming apparatus 100. The nozzle rows may be aligned in the main scanning direction.

The sub tank 50 (or the carriage 82) may be fixed to the main body of the image forming apparatus 100. Alternatively, the sub tank 50 (or the carriage 82) may be removable from the main body of the image forming apparatus 100 so that the sub tank 50 is exchanged for a new one when the head 61 is deteriorated or the like. With this structure, the maintenance of the image forming apparatus 100 can be easier to perform.

The structure of the sub tank 50 will be explained later in detail.

With the above-described image forming apparatus 100, when a predetermined signal is input indicating that the formation of an image is started, the sub tank 50 takes the first position and one of the papers S is fed from the paper-feed unit 20 to the transferring mechanism 10. The paper S supplied to the transferring mechanism 10 is electrostatically attracted onto the transfer belt 12 to be further transferred.

While a surface of the paper S passes the place facing the head 61, the paper transfer driver, not shown in the drawings, is intermittently driven. When the transferring of the paper S is terminated, the ink is discharged from the head 61 in accordance with the image to be formed, and an image having a length corresponding to the nozzle rows formed on the nozzle surface of the head 61 is formed on the surface of the paper S. When the image having such a length is formed on the surface of the paper S, the paper S is transferred for an amount corresponding to the length and then the transferring of the paper S is stopped. Then, a next image having the length is formed on the surface of the paper S. By repeating these processes the whole of the image is formed on the paper S. Alternatively, the image may be formed by interlacing where the dots are not formed in order.

The paper S on which the whole of the image is formed is ejected by the paper ejecting unit 30 onto the paper-catch tray 71, or is reversed by the reverse unit 25 to be transferred to the position facing the head 61 again. When the paper S is transferred to the position facing the head 61 again, an image is formed on the other surface of the paper S and the paper S is ejected by the paper ejecting unit 30 onto the paper-catch tray 71.

After finishing the formation of the image, or after repeating the formation of the image and the head 61 needs to be cleaned because of the blocking of the ink or the like, the sub tank 50 is moved from the first position to the second position. Then, the head 61 is capped by the maintenance and recovery mechanism 40, and the head 61 is cleaned by the maintenance and recovery mechanism 40 such as being suctioned or the like.

When the formation of the image or the cleaning is performed, the ink in the sub tank 50 is decreased and therefore, it is necessary to supply the ink in the sub tank 50.

FIG. 2A to FIG. 2F are cross-sectional views showing the sub tank 50 of the image forming apparatus 100 shown in FIG. 1.

Figure 2A:
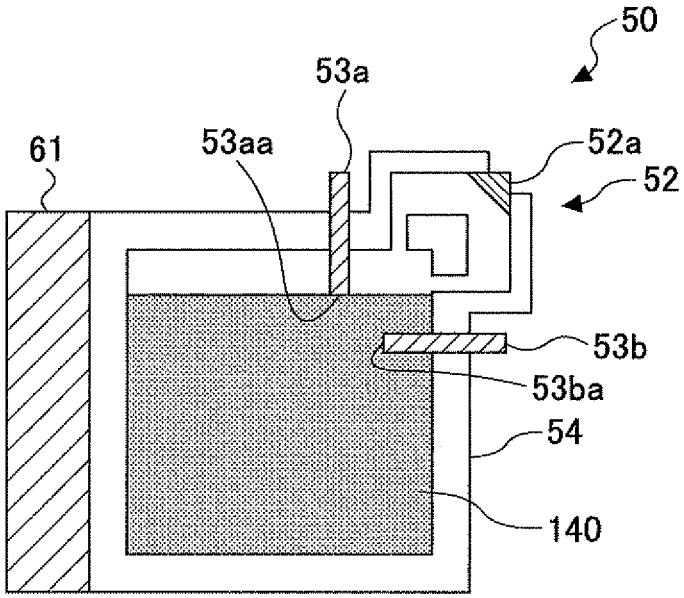
FIG. 2A to FIG. 2F are cross-sectional views showing an example of a sub tank of the image forming apparatus shown in FIG. 1.

The sub tank 50, as shown in FIG. 2A, further includes an ink reservoir 54, the first pin-type bar electrode 53*a* (a first detecting sensor) and the second pin-type bar electrode 53*b* (a second detecting sensor). The ink reservoir 54 contains ink 140 to be discharged from the head 61. The first and second electrodes 53*a* and 53*b* function as detecting sensors for detecting an amount of the ink 140 in the sub tank 50. The first and second electrodes 53*a* and 53*b* are fixed in the ink reservoir 54.

As described above, the image forming apparatus 100 includes plural of the sub tanks 50 corresponding to the plural colors used in the image forming apparatus 100, though only one of the sub tanks 50 is shown in the drawings. The structure and the operation of all of the sub tanks 50 are the same as follows.

The valve unit 52 includes a valve 52*a* and a spring member not shown in the drawings. The spring member pushes the valve 52*a* to close the ink reservoir 54 from outside of the ink reservoir 54 in the sub tank 50 when the switch mechanism 84 is not driven. When the switch mechanism 84 is driven, the valve 52*a* opens the valve unit 52 to have the air in the ink reservoir 54 ejected or released outside and to have the ink supplied from the tube 83 introduced inside the ink reservoir 54. Thus, the valve unit 52 functions as a switch valve to open and close the ink reservoir 54 to and from the atmosphere.

The first and second electrodes 53*a* and 53*b* are used to detect whether a predetermined appropriate amount of the ink 140 is contained in the ink reservoir 54. The first and second electrodes 53*a* and 53*b* are provided to face directions different from each other such that whether the ink reservoir 54 contains a first predetermined amount of the ink for the first position is determined based on whether the first detecting sensor 53*a* contacts the ink when the sub tank 50 takes the first position, and whether the ink reservoir 54 contains a second predetermined amount of the ink for the second position is determined based on whether the second detecting sensor 53*b* contacts the ink when the sub tank 50 takes the second position. In other words, the first predetermined amount of the ink for the first position is defined by the position or the facing direction of the first detecting sensor 53*a* and the second predetermined amount of the ink for the second position is defined by the position or the facing direction of the second detecting sensor 53*b*.

Figure 2B:
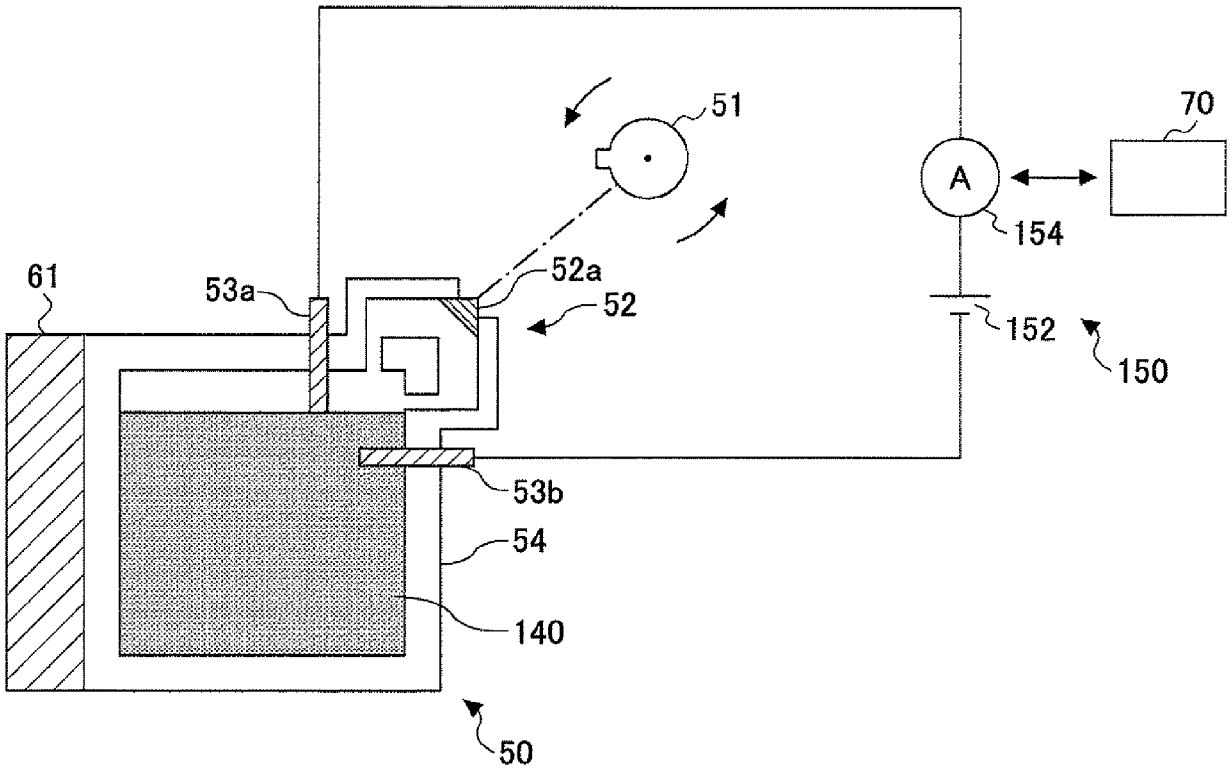

As shown in FIG. 2B, the image forming apparatus 100 includes a circuit 150 including a power source 152, an electric current meter 154 and the like connected to the first and second electrodes 53*a* and 53*b*, in its main body.

The control unit 70 is connected to the electric current meter 154. The circuit 150 and the control unit 70 function as a detecting unit. When the first and second electrodes 53*a* and 53*b* touch the ink 140 in the ink reservoir 54, current flows between the first and second electrodes 53*a* and 53*b* via the ink 140. The electric current meter 154 of the embodiment measures the current value of the current that flows between the first and second electrodes 53*a* and 53*b*. The control unit 70 detects the current value measured by the electric current meter 154 and determines that the ink 140 exists in the ink reservoir 54 to a certain extent to touch the first and second electrodes 53*a* and 53*b*.

As described above, the first and second electrodes 53*a* and 53*b* function as the detecting sensor such as an ink amount detecting sensor or a liquid level detecting sensor for detecting an amount of or the liquid level of the ink 140 in the ink reservoir 54 in order to detect shortage of the ink 140 in the ink reservoir 54. The control unit 70 determines whether the first and second electrodes 53*a* and 53*b* are submerged in or touch the ink 140 based on the current value measured by the electric current meter 154.

In this embodiment, when the sub tank 50 takes the first position or the second position, if at least one of the first and second electrodes 53*a* and 53*b* is not submerged in or is not touching the ink 140, it means that the ink 140 is in short supply so that the ink is to be supplied to the ink reservoir 54.

Here, according to the present embodiment, the first electrode 53*a* and the second electrode 53*b* are provided so that the lowest portion (an edge 53*aa*) of the first electrode 53*a* is positioned higher than the lowest portion of the second electrode 53*b* when the sub tank 50 takes the first position, and the lowest portion (an edge 53*ba*) of the second electrode 53*b* is positioned higher than the lowest portion of the first electrode 53*a* when the sub tank 50 takes the second position.

Therefore, when the sub tank 50 takes the first position, the first electrode 53*a* functions as the detecting sensor for detecting the shortage of the ink 140. In other words, the first electrode 53*a* is provided so that its lowest portion (the edge 53*aa*) is positioned at the level where the ink 140 is to exist when the sub tank 50 takes the first position for forming an image.

On the other hand, when the sub tank 50 takes the second position, the second electrode 53*b* functions as the detecting sensor for detecting the shortage of the ink 140. In other words, the second electrode 53*b* is provided so that its lowest portion (the edge 53*ba*) is positioned at the level where the ink 140 is to exist when the sub tank 50 takes the second position for maintenance.

Figure 2C:
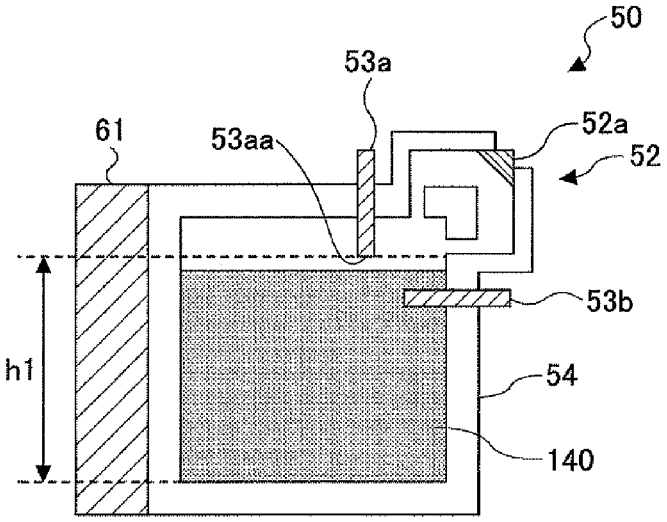

The control unit 70 determines that the ink 140 is in short supply when at least one of the first and second electrodes 53*a* and 53*b* is not submerged in or is not touching the ink 140 in the ink reservoir 54, as shown in FIG. 2C. In FIG. 2C, as the sub tank 50 takes the first position, the lowest portion of the first electrode 53*a* is positioned higher than the second electrode 53*b*. Thus, when the ink 140 decreases not to touch the first electrode 53*a*, the current does not flow through the first electrode 53*a* and the second electrode 53*b*. Thus, the control unit 70 can detect the shortage of the ink 140 in the ink reservoir 54.

When the control unit 70 determines that the ink 140 is in short supply, the switch mechanism 84 and the pump of the ink supply mechanism 80 are driven to transfer the ink in the ink cartridge 81 to the ink reservoir 54 until the first and the second electrodes 53*a* and 53*b* are submerged in or touch the ink 140 in the ink reservoir 54.

Figure 2D:
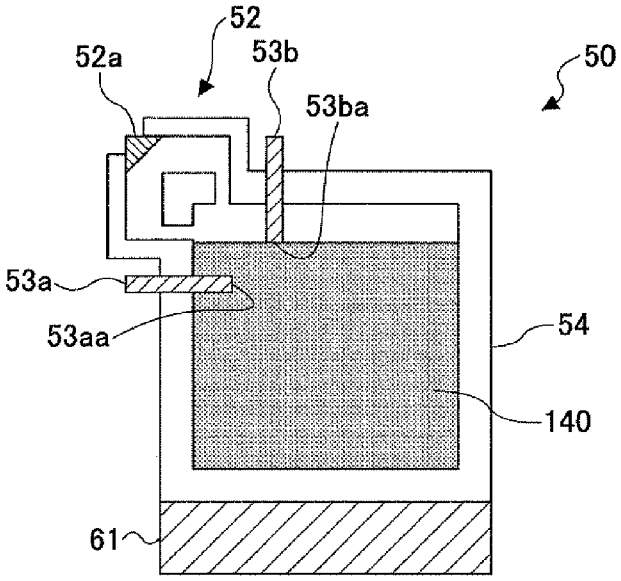
Figure 2E:
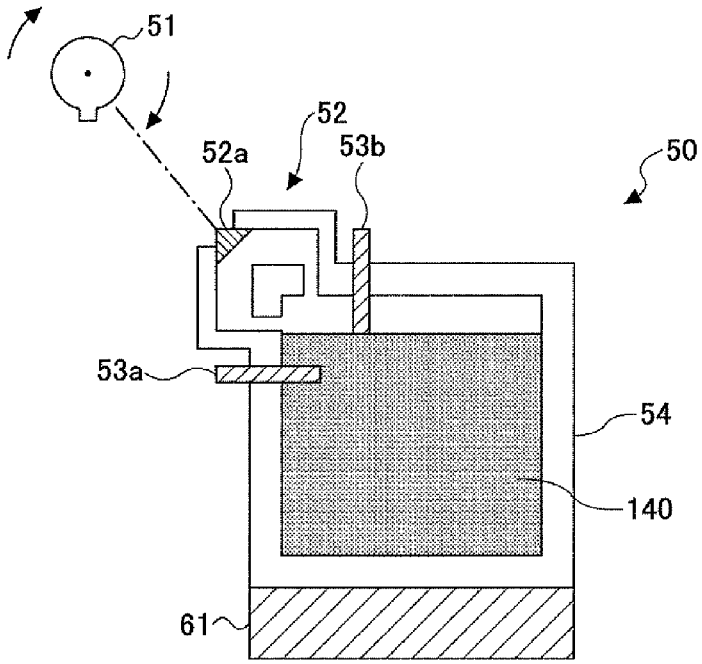
Figure 2F:
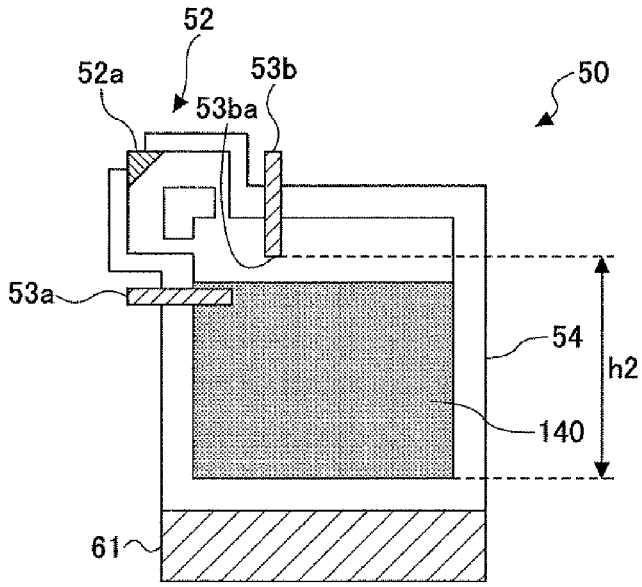

As described above, the sub tank 50 is rotatable within a paper plane of FIG. 1 or FIG. 2A to FIG. 2F. The sub tank 50 takes the first position in FIG. 2A to FIG. 2C. When the sub tank 50 is rotated around the guide rod 51 in the counterclockwise direction as shown by arrows in FIG. 2B by the head position driver 90, the sub tank 50 takes the second position as shown in FIG. 2D to FIG. 2F. When, on the other hand, the sub tank 50 is rotated around the guide rod 51 in the clockwise direction as shown by arrows in FIG. 2E by the head position driver 90, the sub tank 50 takes the first position as shown in FIG. 2A to FIG. 2C.

In FIG. 2F, as the sub tank 50 takes the second position, the lowest portion of the second electrode 53*b* is positioned higher than the first electrode 53*a*. Thus, when the ink 140 decreases not to touch the second electrode 53*b*, the current does not flow through the first electrode 53*a* and the second electrode 53*b*. Thus, the control unit 70 can detect the shortage of the ink 140 in the ink reservoir 54.

The paper planes of FIG. 2A to FIG. 2F are in parallel relationship with the rotating planes of the sub tank 50 and the ink reservoir 54. Although the container 54 is shown to have a square shape in the cross-sectional view in FIG. 2A to FIG. 2F, the container 54 may take another shape as will be explained later.

In this embodiment, the first and second electrodes 53*a* and 53*b* are provided in the ink reservoir 54 such that an edge

53*aa* of the first electrode 53*a* and an edge 53*ba* of the second electrode 53*b*, those edges being positioned to touch the ink 140, face different directions within the rotating plane of the sub tank 50 or the ink reservoir 54. When the sub tank 50 takes the first position, as shown in FIG. 2B, the first and second electrodes 53*a* and 53*b* are positioned in the left and lower direction with respect to the guide rod 51. On the other hand, when the sub tank 50 takes the second position, as shown in FIG. 2E, the first and second electrodes 53*a* and 53*b* are positioned in the right and lower direction with respect to the guide rod 51. It means that the relative position or phase with respect to the center of the rotation which corresponds to the guide rod 51 varies between when the sub tank 50 takes the first position and when the sub tank 50 takes the second position.

Concretely, the first electrode 53*a* is provided at the upper surface of the ink reservoir 54 when the sub tank 50 takes the first position as shown in FIG. 2A to 2C. Thus, by providing the edge 53*aa* of the first electrode 53*a* at a position corresponding to the height h1 from a bottom surface of the ink reservoir 54, where the ink 140 is intended to exist when the sub tank 50 takes the first position, as shown in FIG. 2C, the shortage of the ink 140 when the sub tank 50 takes the first position can be detected.

Similarly, the second electrode 53*b* is provided at the upper surface of the ink reservoir 54 when the sub tank 50 takes the second position as shown in FIG. 2D to 2F. Thus, by providing the edge 53*ba* of the second electrode 53*b* at a position corresponding to the height h2 from a bottom surface of the ink reservoir 54, where the ink 140 is intended to exist when the sub tank 50 takes the second position, as shown in FIG. 2F, a shortage of the ink 140 when the sub tank 50 takes the second position can be detected.

The first and second electrodes 53*a* and 53*b* may be provided in different rotating planes as long as the edge 53*aa* and the edge 53*ba* face different directions when projected on the same rotating plane. The first and second electrodes 53*a* and 53*b* may be provided in the rotating planes different from that of the ink reservoir 54.

The merit of the first and second electrodes 53*a* and 53*b* provided as described above is explained.

Figure 9B:
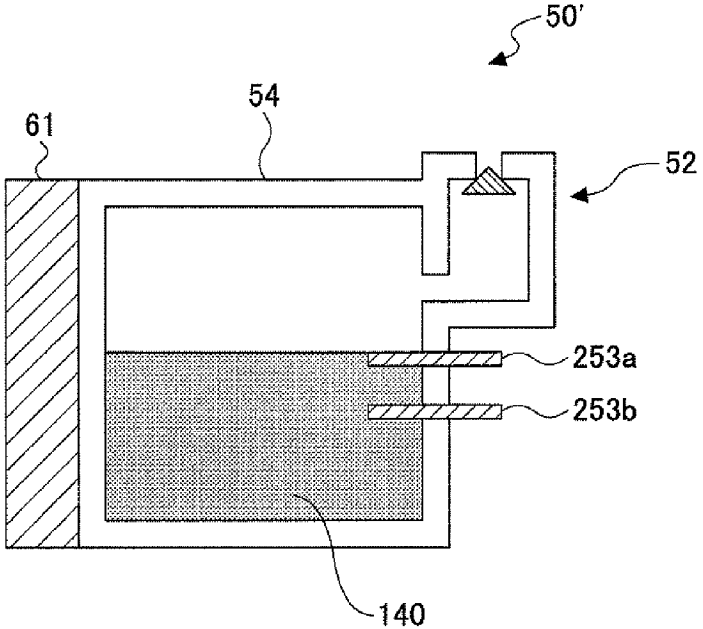
FIG. 9A and FIG. 9B are cross-sectional views showing a relative example of a sub tank.
Figure 9A:
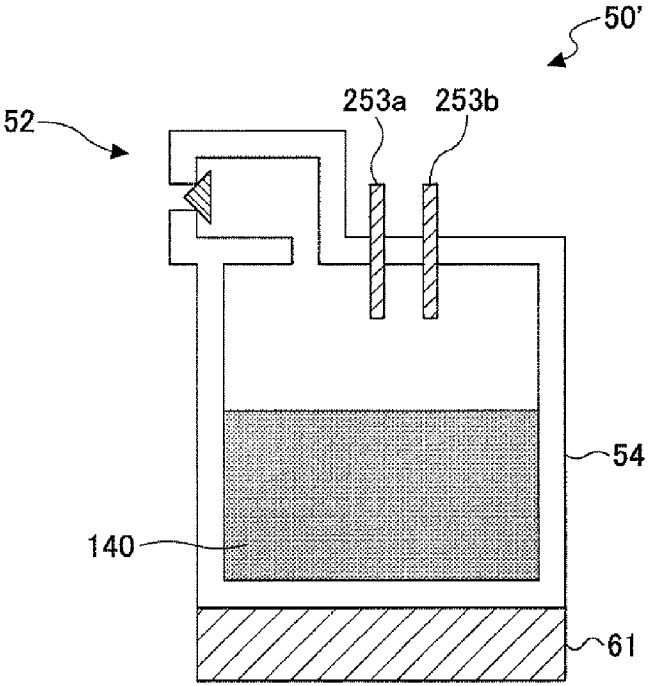

FIG. 9A and FIG. 9B are cross-sectional views showing a relative example of a sub tank 50'.

In this example, the first and second electrodes 253*a* and 253*b* are provided at the same surface of the ink reservoir 54 so that the first and second electrodes 253*a* and 253*b* face the same direction. Concretely, the first and second electrodes 253 and 253*b* are provided at the upper surface of the ink reservoir 54 and face downward as shown in FIG. 9A when the sub tank 50' takes the second position.

When the amount of the ink 140 in the ink reservoir 54 decreases as shown in FIG. 9A, where the sub tank 50' takes the second position, as the first and second electrodes 253 and 253*b* do not touch the ink 140, the shortage of the ink 140 can be detected. However, when the amount of the ink 140 is at this level and the sub tank 50' is rotated to take the first position as shown in FIG. 9B, the shortage of the ink 140 cannot be detected as the first and second electrodes 253 and 253*b* are submerged in the ink 140 even though the amount of the ink 140 is in short supply.

Figure 10B:
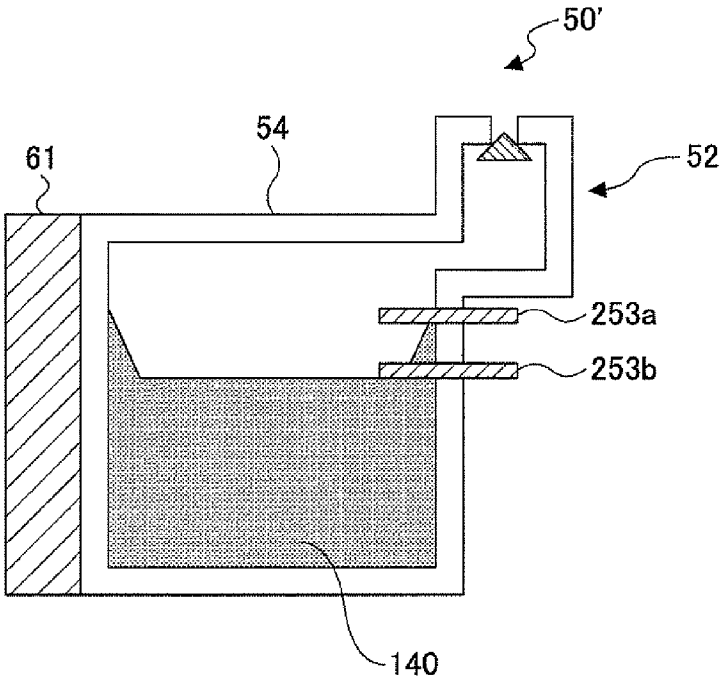
FIG. 10A and FIG. 10B are cross-sectional views showing another relative example of the sub tank.
Figure 10A:
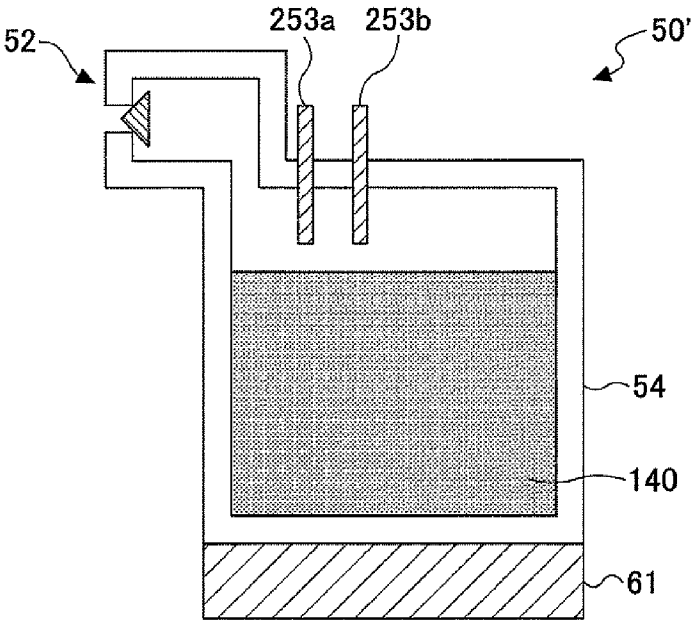

FIG. 10A and FIG. 10B are cross-sectional views showing another relative example of the sub tank 50'. The sub tank 50' shown in FIG. 10A and FIG. 10B has a structure similar to that shown in FIG. 9A and FIG. 9B.

The shortage of the ink 140 may be detected by the first and second electrodes 253*a* and 253*b* when the amount of the ink 140 is in short supply when the sub tank 50' takes the second position where the first and second electrodes 253*a* and 253*b* are provided at the upper surface of the ink reservoir 54 as shown in FIG. 10A. However, when the first and second electrodes 253*a* and 253*b* are provided at the same surface of the ink reservoir 54, when the sub tank 50' is rotated to take the first position where the first and second electrodes 253*a* and 253*b* are provided at the side surface of the ink reservoir 54 as shown in FIG. 10B, the shortage of the ink 140 in the ink reservoir 54 cannot be detected when the ink 140 contacts both the first and second electrodes 253*a* and 253*b* because of the surface tension of the ink 140.

Referring back to FIG. 2A to FIG. 2F, according to the configuration of the first and second electrodes 53*a* and 53*b* in the sub tank 50 of the image forming apparatus 100 of the embodiment, as the first and second electrodes 53*a* and 53*b* are provided to face different directions within the rotating plane of the ink reservoir 54, the shortage of the ink 140 can be properly detected when the sub tank 50 takes the first position as well as when the sub tank 50 takes the second position.

Referring to FIG. 10B, when the first and second electrodes 253*a* and 253*b* are provided to have a long separation distance, the surface tension effect of the ink 140 may not occur even when the first and second electrodes 253*a* and 253*b* are provided at the side surface of the ink reservoir. However, it may be difficult to have a long separation distance between the first and second electrodes 253*a* and 253*b* based on the structure of the sub tank 50' or the other components of the image forming apparatus.

On the other hand, according to the image forming apparatus 100 of the embodiment, the first and second electrodes 53*a* and 53*b* may be freely provided at any place of the respective surfaces.

According to the image forming apparatus 100 of the embodiment, the first and second electrodes 53*a* and 53*b* are respectively provided at adjacent surfaces of the ink reservoir 54 along the rotating direction of the ink reservoir 54. Further, according to the image forming apparatus 100 of the embodiment, the valve unit 52 and the valve 52*a* are provided at a corner between such adjacent surfaces of the ink reservoir 54.

It means that the valve unit 52 is positioned between the first and second electrodes 53*a* and 53*b*, and therefore, the valve 52*a* is capable of being driven from a predetermined direction; concretely, from the upper direction, in both cases when the sub tank 50 takes the first position and when the sub tank 50 takes the second position. When the valve 52*a* is pushed from the upper direction, the valve 52*a* opens the ink reservoir 54 to eject the air in the ink reservoir 54 as well as introduce the ink supplied from the tube 83 into the ink reservoir 54.

Therefore, the switch mechanism 84 may include a pushing mechanism such as an actuator, not shown in the drawings, that pushes the valve 52*a* against the force of the spring member, not shown in the drawings, of the valve unit 52 from the predetermined direction, which is the upper direction. The switch mechanism 84 movably supports the pushing mechanism such that the pushing mechanism moves leftward and rightward with respect to the rotation of the sub tank 50 so that the pushing mechanism can push the valve unit 52 from the upper direction in both cases when the sub tank 50 takes the first position and when the sub tank 50 takes the second position. With this structure, the image forming apparatus 100 of the embodiment can be constructed at a lower cost.

Alternatively, the image forming apparatus 100 of the embodiment may include plural of the pushing mechanisms corresponding to the first position and the second position.

With this structure, the valve 52*a* may not be provided at the corner of the sub tank 50 as the sub tank 50' shown in FIG. 9A and FIG. 9B.

The above pushing mechanism can be applied for the image forming apparatus in which the head faces a lateral direction in both cases for forming an image and performing maintenance or the image forming apparatus in which the head faces downward in both cases for forming an image and performing maintenance.

However, based on the shape of the ink reservoir 54, the first and second electrodes 53*a* and 53*b* may not be provided at the adjacent surfaces of the ink reservoir 54 in the rotating direction of the ink reservoir 54. Further, the shape of a cross-sectional view of the ink reservoir 54 in the rotating plane of the sub tank 50 may not be limited to a square as described in this embodiment and may have a rectangular shape or the like. The first and second electrodes 53*a* and 53*b* may be provided at a curved surface.

According to the image forming apparatus 100 of the embodiment, the first and second electrodes 53*a* and 53*b* are provided to protrude from the respective surfaces where these are provided so that the edges 53*aa* and 53*ba* of the first and second electrodes 53*a* and 53*b* face the inside of the ink reservoir 54. Further, the first and second electrodes 53*a* and 53*b* are provided such that the edges 53*aa* and 53*ba* of the first and second electrodes 53*a* and 53*b* are positioned lower than the valve unit 52 (valve 52*a*) when the sub tank 50 takes the first position and when the sub tank 50 takes the second position. When the ink 140 is introduced in the ink reservoir 54, the introduction of the ink 140 is terminated when both the first and second electrodes 53*a* and 53*b* touch the ink 140. Therefore, the introduction of the ink 140 is terminated before the ink 140 reaches the level of the valve unit 52 when the sub tank 50 takes the first position and when the sub tank 50 takes the second position so that the ink 140 does not flow out from the valve unit 52.

Further, the first and second electrodes 53*a* and 53*b* are provided to be perpendicular with respect to the respective surfaces where these are provided. Concretely, the first electrode 53*a* is provided at the upper surface of the ink reservoir 54 to extend in the vertical direction when the sub tank 50 takes the first position and the second electrode 53*b* is provided at the upper surface of the ink reservoir 54 to extend in the vertical direction when the sub tank 50 takes the second position. Therefore, constructing of the first and second electrodes 53*a* and 53*b* and controlling of the detection of the amount of the ink by the first and second electrodes 53*a* and 53*b* can be easily performed similarly to the structure shown in FIG. 9A to FIG. 10B.

Figure 3:
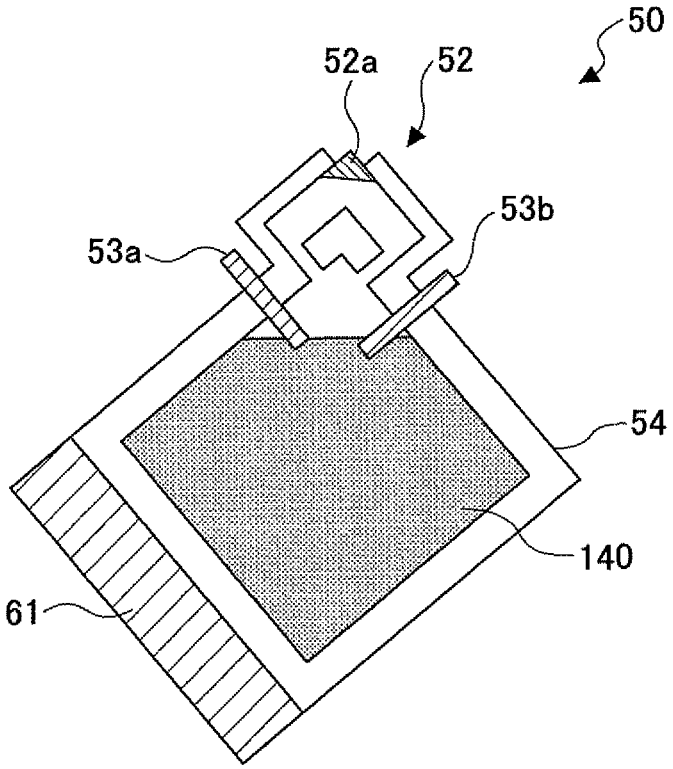
FIG. 3 is a cross-sectional view showing the sub tank shown in FIG. 2 taking a different position.

Further, when the image forming apparatus 100 is placed in an inclined position and the sub tank 50 is used with the inclined position as shown in FIG. 3, the amount of the ink 140 supplied in the ink reservoir 54 is controlled within the amount where the ink 140 touches the first and second electrodes 53*a* and 53*b* so that the leakage of the ink 140 from the sub tank 50 can be prevented.

Alternatively, the first and second electrodes 53*a* and 53*b* may be provided in the ink reservoir 54 such that the edges 53*aa* and 53*ba* are positioned at the same planes as the respective surfaces of the ink reservoir 54 where the first and second electrodes 53*a* and 53*b* are provided, respectively, depending on the shape of the sub tank 50.

When the first and second electrodes 53*a* and 53*b* are provided to protrude from the respective surfaces, the following merit can be obtained.

Figure 4B:
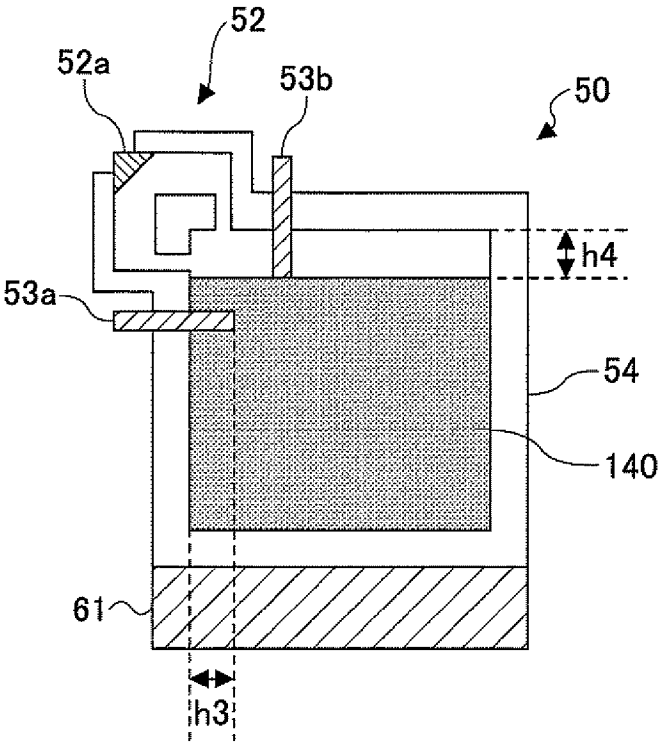
FIG. 4A and FIG. 4B are cross-sectional views showing another example of the sub tank of the image forming apparatus shown in FIG. 1.
Figure 4A:
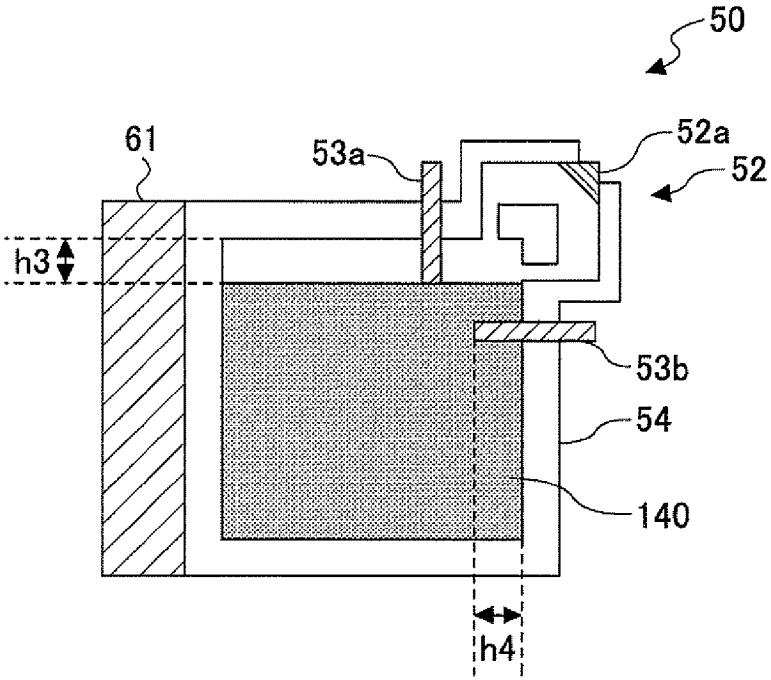

FIG. 4A and FIG. 4B are cross-sectional views showing another example of the sub tank 50 of the image forming apparatus 100 shown in FIG. 1.

In this example, the first and second electrodes 53*a* and 53*b* are provided so that the second predetermined amount of the ink for the second position is greater than the first predetermined amount of the ink for the first position.

In this example, the protruding amounts of the first and second electrodes 53*a* and 53*b* from the respective surfaces where the first and second electrodes 53*a* and 53*b* are provided are different. As shown in FIG. 4A and FIG. 4B, the first electrode 53*a* protrudes from the surface of the ink reservoir 54 for the height h3 while the second electrode 53*b* protrudes from the surface of the ink reservoir 54 for the height h4 where the height h3 is greater than the height h4, for example.

With this structure, the control unit 70 can detect the shortage of the ink 140 with the different amounts of the ink 140 for the first position and the second position.

For this example, as the protruding amount (h3) of the first electrode 53*a* is greater than the protruding amount (h4) of the second electrode 53*b*, the liquid level of the ink 140 where the shortage is detected in the second position as shown in FIG. 4B is higher than the liquid level of the ink 140 where the shortage is detected in the first position as shown in FIG. 4A. In another words, the shortage of the ink 140 is easily detected when the maintenance is performed. Therefore, when the maintenance is performed at the second position, the amount of the ink 140 in the ink reservoir 54 becomes larger so that the maintenance can be appropriately performed; while when the image is formed at the first position, the amount of the ink 140 in the ink reservoir 54 becomes smaller so that the image formation can be appropriately performed. The protruding amount of the first electrode 53*a* may be less than that of the second electrode 53*b* for other purposes.

Figure 5B:
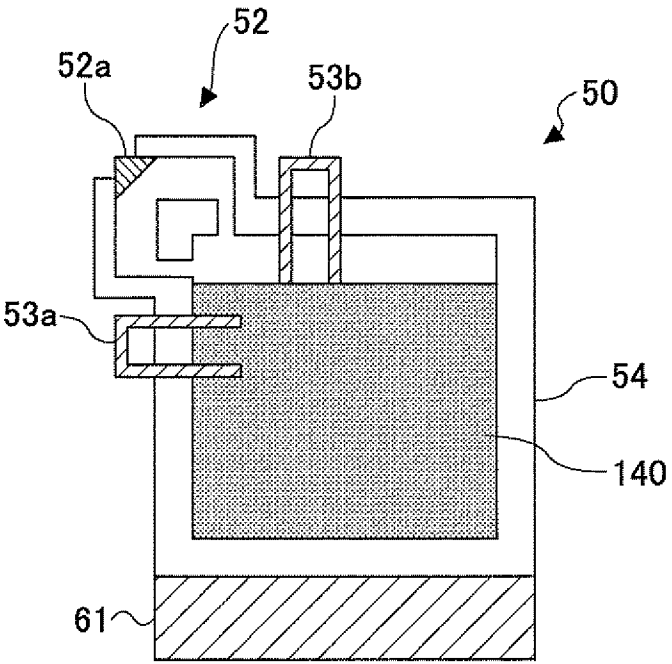
FIG. 5A and FIG. 5B are cross-sectional views showing another example of the sub tank of the image forming apparatus shown in FIG. 1.
Figure 5A:
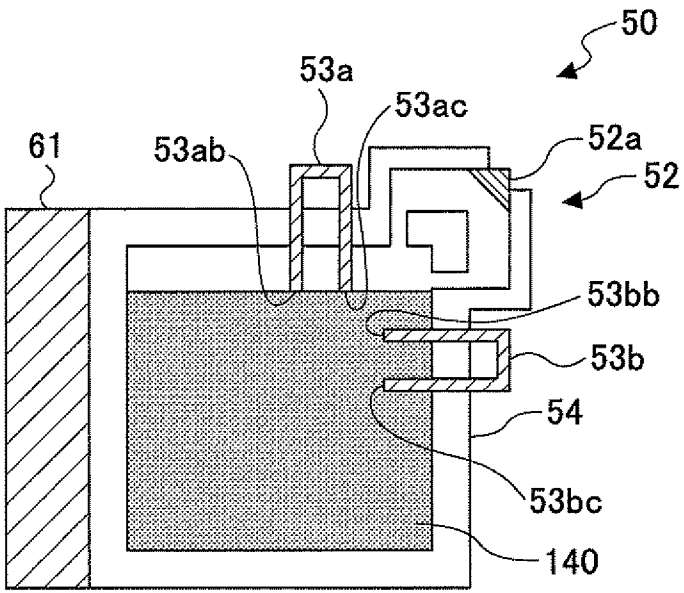

FIG. 5A and FIG. 5B are cross-sectional views showing another example of the sub tank 50 of the image forming apparatus 100 shown in FIG. 1.

At least one of the first and second electrodes 53*a* and 53*b* may have separated edges. For the example shown in FIG. 5, both the first and second electrodes 53*a* and 53*b* have separated edges 53*ab* and 53*ac*, and 53*bb* and 53*bc*, respectively. The first and second electrodes 53*a* and 53*b* respectively have a U-shape where other than the base part is separated. The edges 53*ab* and 53*ac* of the first electrode 53*a* are positioned the same level. The edges 53*bb* and 53*bc* of the second electrode 53*b* are positioned at the same level.

With this structure, even when the current does not flow through one of the edges because of contamination or the like when the edges touch the ink 140, if the current flows through the other one of the edges, the detection of the amount of the ink 140 can be properly performed. The first and second electrodes 53*a* and 53*b* may be separated into more than two.

Figure 6B:
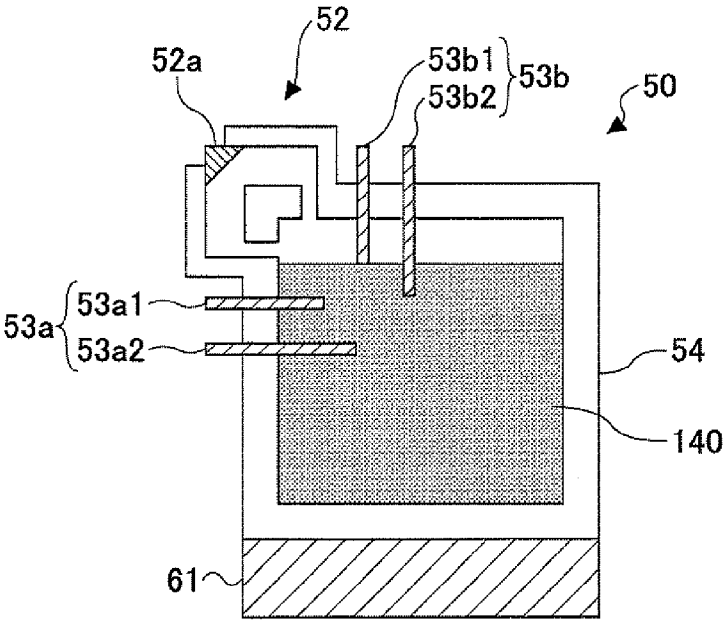
FIG. 6A and FIG. 6B are cross-sectional views showing another example of the sub tank of the image forming apparatus shown in FIG. 1.
Figure 6A:
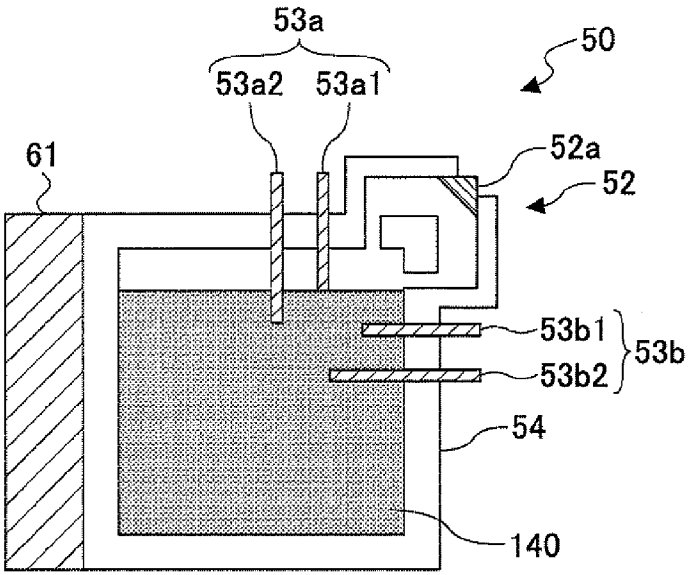

FIG. 6A and FIG. 6B are cross-sectional views showing another example of the sub tank 50 of the image forming apparatus 100 shown in FIG. 1.

The first and second electrodes 53*a* and 53*b* may be composed of plural electrodes, where whole parts of the electrodes 53*a* and 53*b* are separated, respectively.

In this example, the first electrode 53*a* is composed of two electrodes 53*a*1 and 53*a*2. The second electrode 53*b* is also composed of two electrodes 53*b*1 and 53*b*2. By the first and second electrodes 53*a* and 53*b* having plural electrodes, a fail-safe condition is obtained, where the amount of the ink can be properly controlled.

Further, in this example, the protruding amounts of the electrodes 53*a*1 and 53*a*2 of the first electrode 53*a* are different where the electrodes 53*a*1 (which will be referred to as a shorter electrode 53*a*1) is shorter than the electrodes 53*a*2 (which will be referred to as a longer electrode 53*a*2). The protruding amounts of the electrodes 53*b*1 and 53*b*2 of the second electrode 53*b* are different where the electrodes 53*b*1 (which will be referred to as a shorter electrode 53*b*1) is shorter than the electrodes 53*b*2 (which will be referred to as a longer electrode 53*b*2). With this structure, fail-safe is obtained.

Further, in this example, the current values between various combinations of the electrodes can be measured. For example, the current value between the shorter electrode 53*a*1 of the first electrode 53*a* and the shorter electrode 53*b*1 of the second electrode 53*b*, the shorter electrode 53*a*1 of the first electrode 53*a* and the longer electrode 53*b*2 of the second electrode 53*b*, the longer electrode 53*a*2 of the first electrode 53*a* and the shorter electrode 53*b*1 of the second electrode 53*b*, or the longer electrode 53*a*2 of the first electrode 53*a* and the longer electrode 53*b*2 of the second electrode 53*b* may be measured. With this structure, plural amounts of the ink 140 can be detected.

In this example, the distance between the shorter electrode 53*a*1 and the longer electrode 53*a*2 of the first electrode 53*a*, and the distance between the shorter electrode 53*b*1 and the longer electrode 53*b*2 of the second electrode 53*b* may be long enough so that the surface tension effect of the ink 140 does not occur.

Figure 7B:
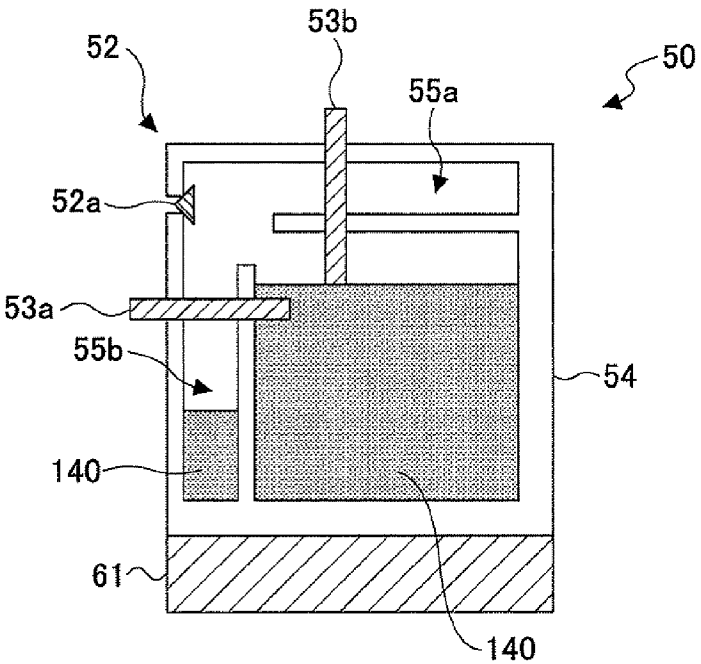
FIG. 7A and FIG. 7B are cross-sectional views showing another example of the sub tank of the image forming apparatus shown in FIG. 1.
Figure 7A:
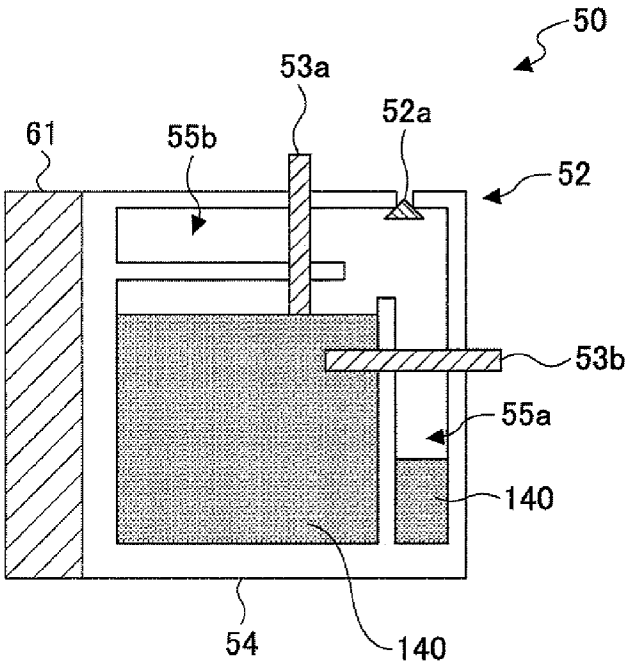

FIG. 7A and FIG. 7B are cross-sectional views showing another example of the sub tank 50 of the image forming apparatus 100 shown in FIG. 1.

In this example, the sub tank 50 may further include ink buffer rooms 55*a* and 55*b* provided at outside of the ink reservoir 54 to contain a flood of the ink 140 from the ink reservoir 54. The ink buffer room 55*a* contains the flood of the ink 140 from the ink reservoir 54 at the first position. The ink buffer room 55*b* contains the flood of the ink 140 from the ink reservoir 54 at the second position. With this structure, even when the termination of the supply of the ink from the ink cartridge 81 into the ink reservoir 54 is delayed, the flood of the ink 140 can be retained in the ink buffer room 55*a* or in the ink buffer room 55*b* to prevent the leakage of the ink from the sub tank 50.

The flood of the ink 140 from the ink reservoir 54 received in the ink buffer room 55*a* when the sub tank 50 takes the first position is moved back into the ink reservoir 54 while the sub tank 50 is rotated to take the second position. Similarly, the flood of the ink 140 from the ink reservoir 54 received in the ink buffer room 55*b* when the sub tank 50 takes the second position is moved back into the ink reservoir 54 while the sub tank 50 is rotated to take the first position. Thus, the ink 140 once supplied into the sub tank 50 from the ink cartridge 81 is effectively used through the ink reservoir 54 to be discharged from the head 61. Alternatively, the sub tank 50 may include either one of the ink buffer rooms 55*a* or 55*b*.

Figure 8A:
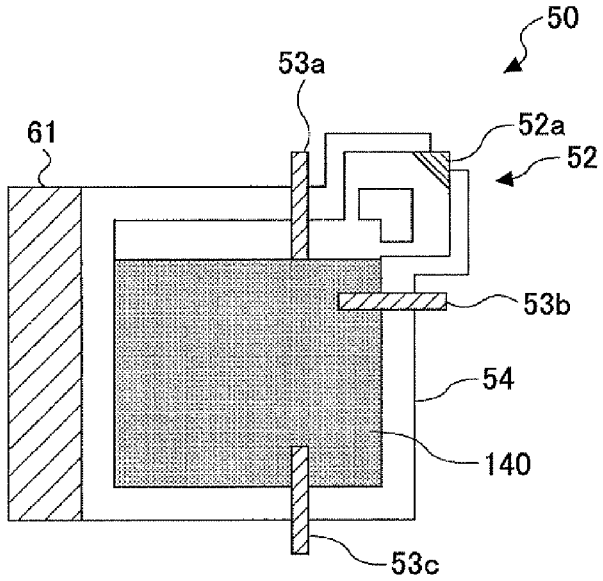
FIG. 8A to FIG. 8C are cross-sectional views showing another example of the sub tank of the image forming apparatus shown in FIG. 1.
Figure 8B:
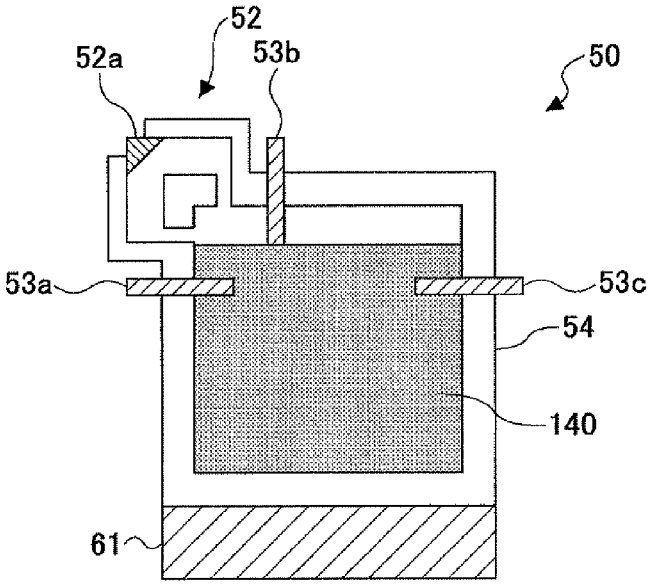
Figure 8C:
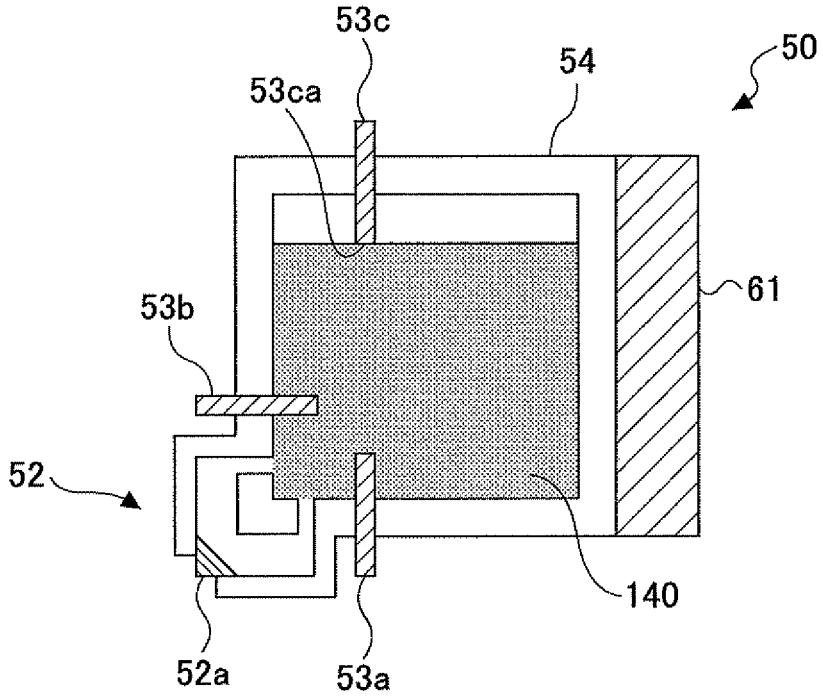

FIG. 8A to FIG. 8C are cross-sectional views showing another example of the sub tank 50 of the image forming apparatus 100 shown in FIG. 1.

In this example, the sub tank 50 further includes a third electrode 53*c* provided at the different surface from the surfaces where the first and second electrode 53*a* and 53*b* are respectively provided.

The third electrode 53*c* may be provided at the position capable of detecting the amount of the ink 140 in the ink reservoir 54 when the sub tank 50 takes a third position different from the first position and the second position. FIG. 8A shows the condition where the sub tank 50 takes the first position, FIG. 8B shows the condition where the sub tank 50 takes the second position, and FIG. 8C shows the condition where the sub tank 50 takes the third position. For the condition shown in FIG. 8C, the sub tank 50 takes the position opposite to that shown in FIG. 8A. It means that in the third position, the valve unit 52 is positioned at the lower side of the sub tank 50. When the sub tank 50 taking the position as shown in FIG. 8B is rotated in the direction opposite to the direction to take the first position, the sub tank 50 takes the third position as shown in FIG. 8C.

According to this example, the first electrode 53*a*, the second electrode 53*b*, and the third electrode 53*c* are provided so that the lowest portion (an edge 53*ca*) of the third electrode 53*c* is positioned higher than the first electrode 53*a* and the second electrode 53*b* when the sub tank 50 takes the third position. When the sub tank 50 takes the third position, the third electrode 53*a* functions as the detecting sensor for detecting the shortage of the ink 140. In other words, the third electrode 53*c* is provided so that its lowest portion (the edge 53*ca*) is positioned at the level where the ink 140 is extended to exist when the sub tank 50 takes the third position.

The third position may be a position for forming an image where the head 61 discharges the ink in a horizontal direction opposite to the direction as shown in FIG. 8A when the duplex image formation is performed, for example, or may be a position for maintenance where an operation different from that performed at the second position is to be performed, for example, a capping operation is performed at the second position as shown in FIG. 8B and a cleaning operation is performed at the third position as shown in FIG. 8C by the maintenance and recovery mechanism 40.

Figure 11A:
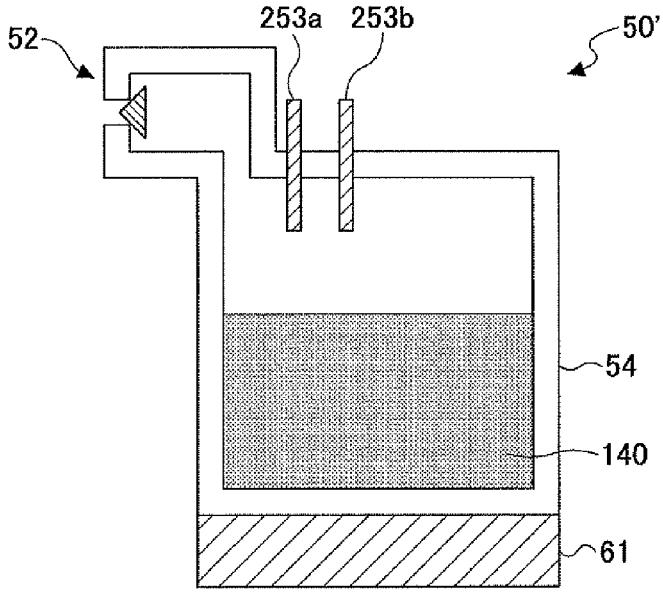
FIG. 11A to FIG. 11C are cross-sectional views showing another example of the sub tank.
Figure 11B:
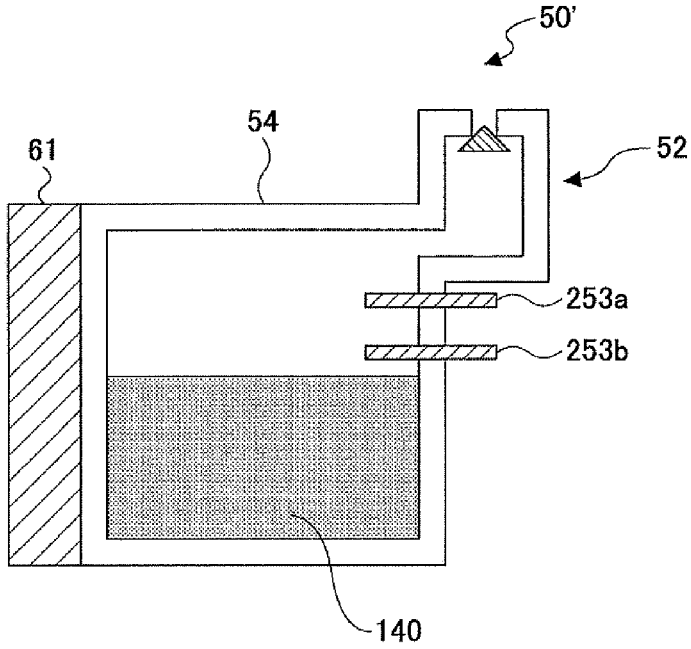
Figure 11C:
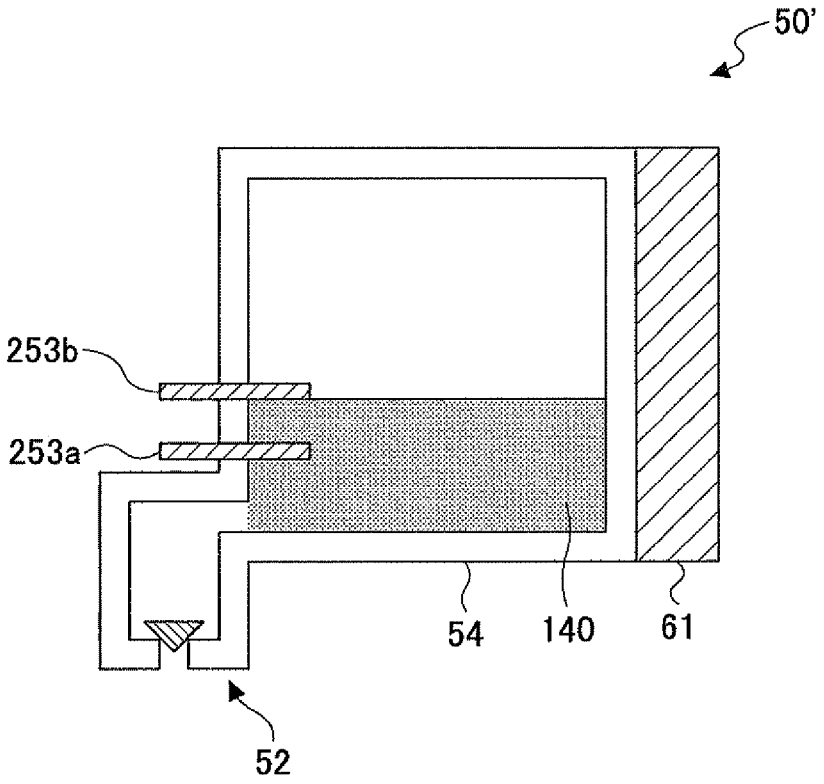

FIG. 11A to FIG. 11C are cross-sectional views showing another example of the sub tank 50'. In the sub tank 50' shown in FIG. 11A and FIG. 11B, the first and second electrodes 253*a* and 253*b* are provided at the same surface of the ink reservoir 54.

When the positions of the first and second electrodes 253*a* and 253*b* are adjusted, for example, to positions at the upper part of the side surface even when the sub tank 50' takes the first position as shown in FIG. 11B, the shortage of the ink 140 in the ink reservoir 53 may be detected. However, for such a structure, the shortage of the ink 140 cannot be detected at the third position as shown in FIG. 11C.

Figure 12:
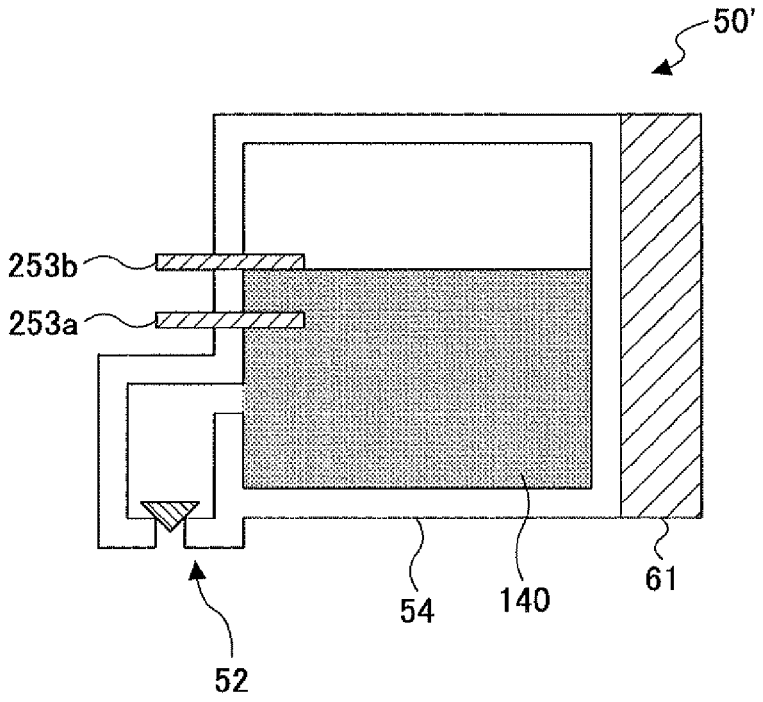
FIG. 12 is a cross-sectional views of the sub tank shown in FIG. 9A and FIG. 9B taking a different position.

Similarly, as shown in FIG. 12, when the sub tank 50' shown in FIG. 9A and FIG. 9B takes the third position, the shortage of the ink 140 cannot be detected.

According to the image forming apparatus 100 of the embodiment, the positions of the first and second electrodes 53*a* and 53*b* may be arbitrary determined as long as they are provided to face different directions or provided at the different surfaces.

Figure 13A:
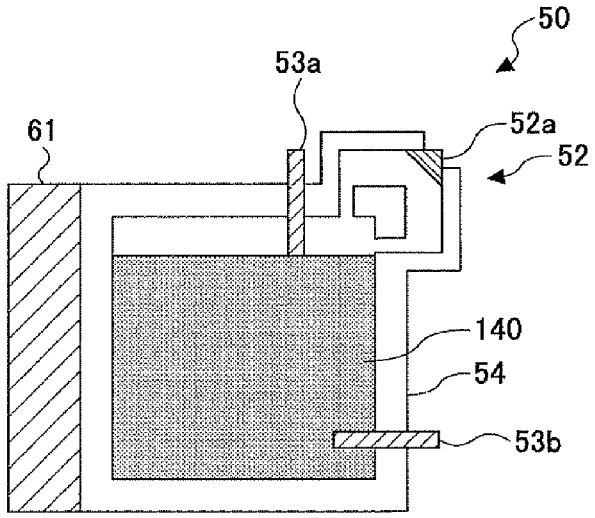
FIG. 13A to FIG. 13C are cross-sectional views showing another example of the sub tank of the image forming apparatus shown in FIG. 1.
Figure 13B:
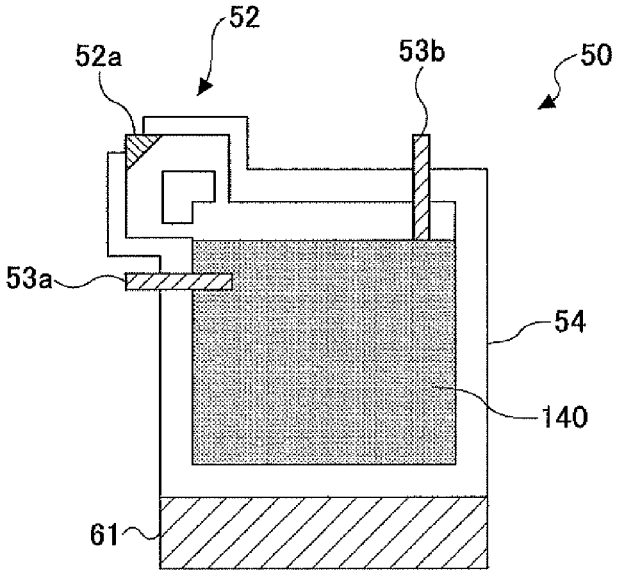
Figure 13C:
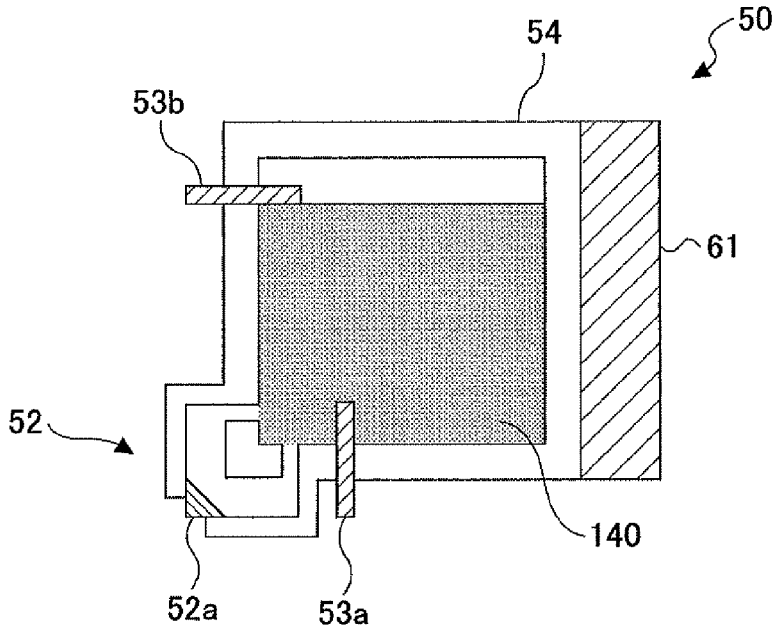

FIG. 13A to FIG. 13C are cross-sectional views showing another example of the sub tank of the image forming apparatus shown in FIG. 1. In this example, the position of the second electrode 53*b* is different from that shown in FIG. 2A to FIG. 2F. With this structure, similar to the structure shown in FIG. 2A to FIG. 2F, the shortage of the ink 140 in the ink reservoir 54 can be detected when the sub tank 50 takes the first position as shown in FIG. 13A and the sub tank 50 takes the second position as shown in FIG. 13B. Further, with this structure, as shown in FIG. 13C, even when the sub tank 50 takes the third position, the shortage of the ink 140 in the ink reservoir can be detected.

Figure 14B:
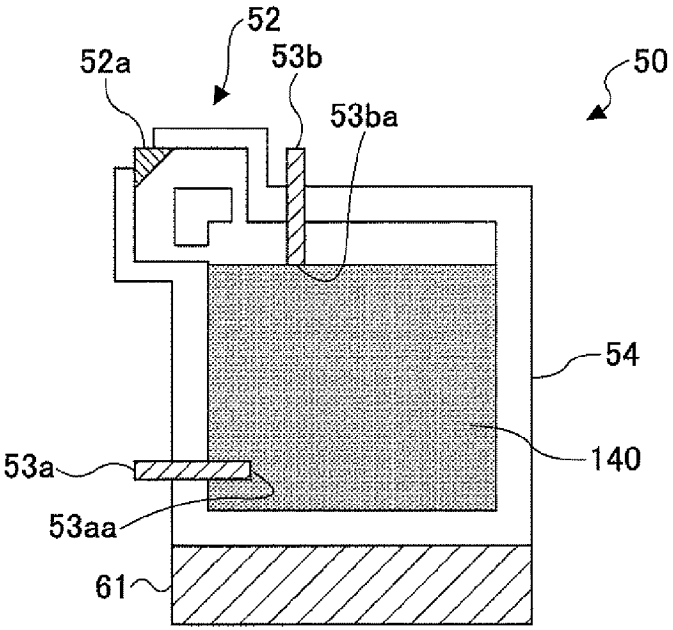
FIG. 14A and FIG. 14B are cross-sectional views showing another example of the sub tank of the image forming apparatus shown in FIG. 1.
Figure 14A:
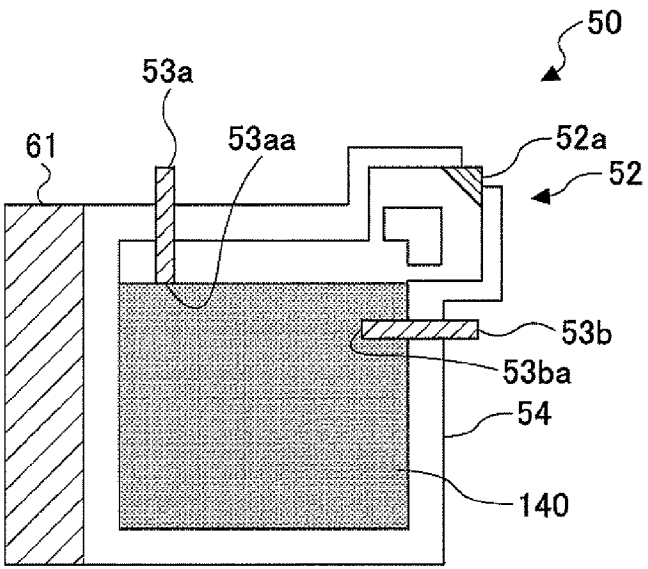

FIG. 14A and FIG. 14B are cross-sectional views showing another example of the sub tank of the image forming apparatus shown in FIG. 1. In this example, the position of the first electrode 53*a* is different from that shown in FIG. 2A to FIG. 2F. With this structure, similar to the structure shown in FIG. 2A to FIG. 2F, the shortage of the ink 140 in the ink reservoir 54 can be detected when the sub tank 50 takes the first position as shown in FIG. 14A and the sub tank 50 takes the second position as shown in FIG. 14B.

Figure 15B:
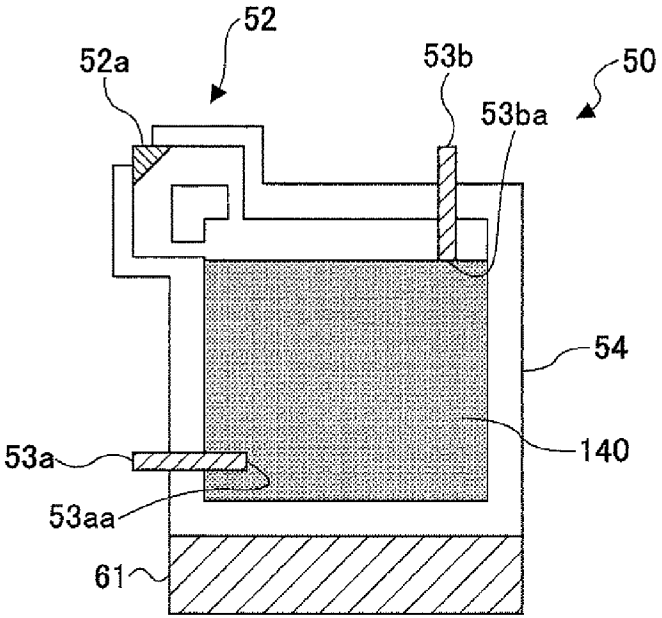
FIG. 15A and FIG. 15B are cross-sectional views showing another example of the sub tank of the image forming apparatus shown in FIG. 1.
Figure 15A:
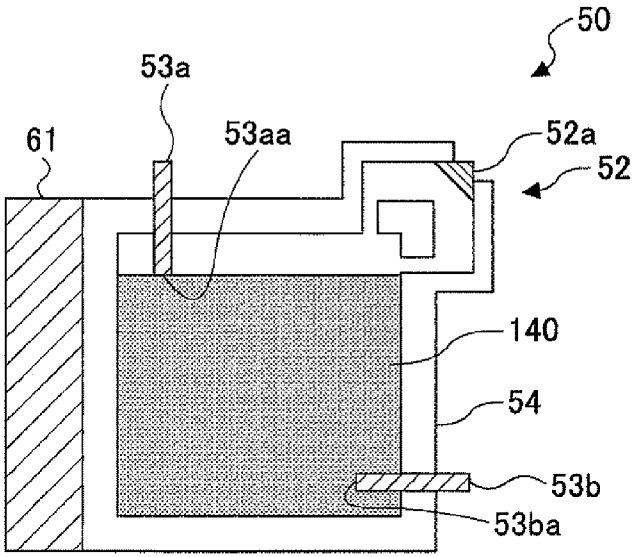

FIG. 15A and FIG. 15B are cross-sectional views showing another example of the sub tank of the image forming apparatus shown in FIG. 1. In this example, the position of the first electrode 53*a* and the second electrode 53*b* are different from those shown in FIG. 2A to FIG. 2F. With this structure, similar to the structure shown in FIG. 2A to FIG. 2F, the shortage of the ink 140 in the ink reservoir 54 can be detected when the sub tank 50 takes the first position as shown in FIG. 15A and the sub tank 50 takes the second position as shown in FIG. 15B. Further, with this structure, similar to the structure shown in FIG. 13C, even when the sub tank 50 takes the third position, the shortage of the ink 140 in the ink reservoir 54 can be detected.

Further, when the first and second electrodes 53*a* and 53*b* are composed of two electrodes, respectively, the detecting unit including a circuit composed of a power source, an electric current meter or the like may be provided to measure the current that flows between the two electrodes of the first electrode 53*a* and the current that flows between the two electrodes of the second electrode 53*b* to detect the predetermined appropriate amount of the ink for the first position and the second position.

According to the present embodiment, there is an ink container integrally formed with a head that discharges ink and rotatable to take a first position where the ink is discharged from the head and a second position different from the first position where the position of the head is different for the first position and the second position, including an ink reservoir that contains the ink to be discharged from the head; and a first detecting sensor and a second detecting sensor to be connected to a detecting unit that determines whether the ink reservoir contains a predetermined amount of the ink based on current flowing through the first detecting sensor and the second detecting sensor, the first detecting sensor and the second detecting sensor being provided to face directions different from each other such that whether the ink reservoir contains a first predetermined amount of the ink for the first position is determined based on whether the first detecting sensor contacts the ink when the ink container takes the first position, and whether the ink reservoir contains a second predetermined amount of the ink for the second position is determined based on whether the second detecting sensor contacts the ink when the ink container takes the second position.

With this structure, when the position or the facing direction of the head is changed between the first position and the second position, a predetermined appropriate amount of the ink in the ink container can be detected with high accuracy so that it is possible to continuously form good images. Further, the ink container of the embodiment is capable of being used with parts used for the general ink container that takes the first position and the second position or the image forming apparatus including the general-purpose ink container.

Further, according to the ink container of the embodiment, the first detecting sensor and the second detecting sensor are provided so that the first predetermined amount of the ink and the second predetermined amount of the ink are different.

With this structure, when the position or the facing direction of the head is changed between the first position and the second position, a predetermined appropriate amount of the ink in the ink container different for the first position and the second position can be detected with high accuracy so that it is possible to continuously form good images. Further, the ink container of the embodiment is capable of being used with parts used for the general-purpose ink container that takes the first position and the second position or the image forming apparatus including the general ink container.

Further, according to the ink container of the embodiment, the first detecting sensor and the second detecting sensor are provided so that the second predetermined amount of the ink is larger than the first predetermined amount of the ink.

With this structure, when the position or the facing direction of the head is changed between the first position and the second position, a predetermined appropriate amount of the ink in the ink container, where the amount is larger for the second position than that for the first position, for the first position and the second position can be detected with a high accuracy so that it is possible to continuously form good images. Further, the ink container of the embodiment is capable of being used with parts used for the general-purpose ink container that takes the first position and the second position or the image forming apparatus including the general-purpose ink container.

Further, according to the ink container of the embodiment, at least either of the first detecting sensor or the second detecting sensor has separated edges.

With this structure, when the position or the facing direction of the head is changed between the first position and the second position, a predetermined appropriate amount of the ink in the ink container can be detected with high accuracy so that it is possible to continuously form good images. Further, the ink container of the embodiment is capable of being used with parts used for the general ink container that takes the first position and the second position or the image forming apparatus including the general ink container.

Further, according to the ink container of the embodiment, at least either of the first detecting sensor or the second detecting sensor includes plural detecting sensors having different height from the bottom of the ink reservoir when the ink container takes the respective position.

With this structure, when the position or the facing direction of the head is changed between the first position and the second position, a predetermined appropriate amount of the ink in the ink container, with different amounts, for the first position and the second position can be detected with high accuracy so that it is possible to continuously form good images. Further, the ink container of the embodiment is capable of being used with parts used for the general-purpose ink container that takes the first position and the second position or the image forming apparatus including the general-purpose ink container.

Further, the ink container of the embodiment may further include a valve unit capable of releasing the air in the ink reservoir provided between the first detecting sensor and the second detecting sensor such that the valve unit is capable of being driven from the same direction in both cases when the ink container takes the first position and when the ink container takes the second position.

With this structure, when the position or the facing direction of the head is changed between the first position and the second position, a predetermined appropriate amount of the ink in the ink container can be detected with high accuracy so that it is possible to continuously form good images. Further, the ink container of the embodiment is capable of being used with parts used for the general-purpose ink container that takes the first position and the second position or the image forming apparatus including the general-purpose ink container. Further, as the valve unit is driven from the same direction in both cases for the first position and the second position the structure for driving the valve unit can be simplified.

Further, the ink container of the embodiment may further include an ink buffer room that contains a flood of the ink from the ink reservoir.

With this structure, when the position or the facing direction of the head is changed between the first position and the second position, a predetermined appropriate amount of the ink in the ink container can be detected with high accuracy so that it is possible to continuously form good images. Further, the leakage of the ink from the ink container can be prevented by the ink buffer room so that it is possible to continuously form good images. Further, the ink container of the embodiment is capable of being used with parts used for the general-purpose ink container that takes the first position and the second position or the image forming apparatus including the general ink container.

Further, according to the image forming apparatus including the ink container, when the position or the facing direction of the head is changed between the first position and the second position, a predetermined appropriate amount of the ink in the ink container can be detected with high accuracy so that it is possible to continuously form good images. Further, the ink container of the embodiment is capable of being used with parts used for the general-purpose ink container that takes the first position and the second position or the image forming apparatus including the general-purpose ink container.

The present invention is not limited to the specifically disclosed embodiments, and variations and modifications may be made without departing from the scope of the present invention.

The present application is based on Japanese Priority Application No. 2011-21106 filed on Feb. 2, 2011, the entire contents of which are hereby incorporated herein by reference.

What is claimed is:

1. An ink container integrally formed with a head that discharges ink and rotatable in a rotation direction to take a first position where the ink is discharged from the head and a second position different from the first position where a position of the head for the first position is different from the position of the head for the second position, comprising:

an ink reservoir that contains the ink to be discharged from the head;

a first detecting sensor and a second detecting sensor to be connected to a detecting unit that determines whether the ink reservoir contains a predetermined amount of the ink based on a current flowing through the first detecting sensor and the second detecting sensor, the first detecting sensor and the second detecting sensor being provided to face directions different from each other such that whether the ink reservoir contains a first predetermined amount of the ink for the first position is determined based on whether the first detecting sensor contacts the ink when the ink container takes the first position, and whether the ink reservoir contains a second predetermined amount of the ink for the second position is determined based on whether the second detecting sensor contacts the ink when the ink container takes the second position;

a first electrode and a second electrode provided at respective surfaces of the ink reservoir, wherein the respective surfaces at which the first and second electrodes are provided are adjacent to each other along the rotation direction of the ink container; and a valve unit, to release air in the ink reservoir, provided at a corner between the adjacent surfaces of the ink reservoir, wherein the valve unit is disposed between the first and second electrodes along the rotation direction of the ink container.

2. The ink container according to claim 1, wherein the first detecting sensor and the second detecting sensor are provided so that the lowest portion of the first detecting sensor is positioned higher than the lowest portion of the second detecting sensor when the ink container takes the first position, and the lowest portion of the second detecting sensor is positioned higher than the lowest portion of the first detecting sensor when the ink container takes the second position.

3. The ink container according to claim 1, wherein the first detecting sensor and the second detecting sensor are provided so that the first predetermined amount of the ink and the second predetermined amount of the ink are different.

4. The ink container according to claim 1, wherein the first detecting sensor and the second detecting sensor are provided so that the second predetermined amount of the ink is greater than the first predetermined amount of the ink.

5. The ink container according to claim 1, wherein at least the first detecting sensor or the second detecting sensor has separated edges.

6. The ink container according to claim 1, wherein at least the first detecting sensor or the second detecting sensor includes plural detecting sensors having different heights from the bottom of the ink reservoir when the ink container takes the respective first or second position.

7. The ink container according to claim 1, wherein the valve unit is provided between the first detecting sensor and the second detecting sensor such that the valve unit is capable of being driven from the same direction when the ink container takes the first position and when the ink container takes the second position.

8. The ink container according to claim 1, further comprising an ink buffer room that contains a flood of the ink from the ink reservoir.

9. The ink container according to claim t, wherein the first detecting sensor and the second detecting sensor are provided such that the relative positions of the first detecting sensor and the second detecting sensor with respect to the center of the rotation of the ink container change when the ink container takes the first position and when the ink container takes the second position.

10. The ink container according to claim 1, wherein the first detecting sensor is provided to protrude from the upper surface of the ink reservoir so that the first detecting sensor faces downward when the ink container takes the first position and the second detecting sensor is provided to protrude from the upper surface of the ink reservoir so that the second detecting sensor faces downward when the ink container takes the second position.

11. The ink container according to claim 1, further comprising a maintenance and recovery mechanism including a cap, wherein the second position is where the head is capped by the cap and maintained by the maintenance and recovery mechanism.

12. The ink container according to claim 1, wherein when the ink container rotated from the first position to the second position, the ink container is rotated about 90 degrees and the first detecting sensor and the second detecting sensor face directions perpendicular to each other.

13. The ink container according to claim 1, wherein the first detecting sensor is composed of an electrode and the second detecting sensor is composed of an electrode.

14. The ink container according to claim 1, wherein the detecting unit to which the first detecting sensor and the second detecting sensor are connected determines whether the ink reservoir contains the predetermined amount of the ink based on the current flowing between the first detecting sensor and the second detecting sensor.

15. An image forming apparatus comprising the ink container according to claim 1.

16. The ink container according to claim 1, wherein the valve unit includes a valve configured to be driven from a predetermined direction, both in a case that the ink container is disposed in the first position and in a case that the ink container is disposed in the second position, and when the valve is driven from the predetermined direction, the valve opens the ink reservoir to eject air in the ink reservoir and to permit ink to be introduced into the ink reservoir.

* * * * *